US007354135B2

(12) United States Patent
Kimura

(10) Patent No.: US 7,354,135 B2
(45) Date of Patent: Apr. 8, 2008

(54) WASTE LIQUID COLLECTING METHOD, LIQUID INJECTING APPARATUS AND CARTRIDGE SET

(75) Inventor: Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 359 days.

(21) Appl. No.: 11/080,020

(22) Filed: Mar. 14, 2005

(65) Prior Publication Data

US 2005/0212850 A1 Sep. 29, 2005

(30) Foreign Application Priority Data

Mar. 16, 2004 (JP) ..... P2004-074982
Jul. 26, 2004 (JP) ..... P2004-217611

(51) Int. Cl.
*B41J 2/165* (2006.01)
*B41J 2/175* (2006.01)

(52) U.S. Cl. ..... 347/36; 347/86

(58) Field of Classification Search ..... 347/22, 347/29, 32, 36, 85, 86
See application file for complete search history.

(56) References Cited

U.S. PATENT DOCUMENTS 6,793,332 B2 * 9/2004 Kaga et al. ..... 347/86
2003/0067521 A1 4/2003 Kaga et al.

FOREIGN PATENT DOCUMENTS

EP 1 016 533 A1 7/2000
EP 1 398 156 A2 3/2004
JP 04-035956 A 2/1992
JP 2003-118144 A 4/2003

* cited by examiner

*Primary Examiner*—Shih-Wen Hsieh
(74) *Attorney, Agent, or Firm*—Stroock & Stroock & Lavan LLP

(57) ABSTRACT

A printer includes a recording head and a maintenance mechanism for sucking an ink in the recording head. A plurality of cartridges to be attached to the printer includes a first housing portion for storing an ink to be supplied to the recording head and a second housing portion for storing a waste ink discharged from the maintenance mechanism. In a first one of the cartridges, the flow path resistance of a cartridge side flow path from a waste ink introducing portion to an air communicating hole for discharging air in a waste ink reservoir portion to an outside through the waste ink reservoir portion is lower than the flow path resistance of each of the cartridge side flow paths of the other cartridges (FIG. 14).

10 Claims, 14 Drawing Sheets

WASTE LIQUID COLLECTING METHOD, LIQUID INJECTING APPARATUS AND CARTRIDGE SET

BACKGROUND OF THE INVENTION

The present invention relates to a waste liquid collecting method, a liquid injecting apparatus and a cartridge set.

An ink jet type recording apparatus (hereinafter referred to as a printer) has been known as a liquid injecting apparatus for discharging a liquid from a liquid injecting head to a target. A maintenance mechanism is usually provided on a non-printing region in the printer. The maintenance mechanism carries out suction cleaning for sucking a thickened ink and air bubbles from a nozzle in order to prevent the nozzle clogging of a recording head to be a liquid injecting head.

A waste ink sucked from the recording head by the maintenance mechanism is fed to a waste ink tank provided in the printer. Alternatively, the waste ink is fed to an ink cartridge including an ink reservoir portion accommodating an unused ink and a waste ink reservoir portion in some cases (for example, see JP-A-2003-118144). In these cases, the waste ink reservoir portion can also be exchanged simultaneously with the exchange of the cartridge. Therefore, it is possible to produce an advantage that a waste liquid accommodating space can be more reduced than the case in which the waste ink tank is provided in the apparatus.

In the ink cartridge described in the JP-A-2003-118144, however, also in a state in which the waste ink is not sufficiently collected, the arrangement posture of the ink cartridge is changed so that the waste ink comes in contact with an air permeable film in some cases. In general, the air permeability of the air permeable film is not reduced even if the waste ink sticks thereto several times. In the case in which the waste ink often sticks and the sticking waste ink is then dried, however, there is a possibility that the air permeability might be reduced. When the air permeability of the air permeable film is reduced, air sucked from the nozzle opening of the recording head together with the waste ink cannot be discharged from a hole. As a result, a waste ink introducing chamber is filled with the air so that the waste ink cannot be collected any more irrespective of the insufficient collection of the waste ink, and the breakdown of the waste ink introducing chamber, the leakage of the waste ink and the damage of the maintenance mechanism might be caused by a rise in a pressure.

In consideration of the problems, it is an object of the invention to provide a liquid housing and a liquid injecting apparatus which can prevent a waste liquid from leaking out depending on an arrangement posture and can maintain an air permeability. In each cartridge described in the JP-A-2003-118144, the volume of a waste liquid reservoir portion is set to be equal irrespective of a difference in an exchange time depending on a difference between the amounts of consumption of various inks. Accordingly, there is a possibility that a cartridge having an early exchange time might be exchanged in a state in which the waste ink filling rate of the waste ink reservoir portion is low. To the contrary, a cartridge having a late exchange time is attached for a long period. For this reason, the waste ink tends to be collected in a large amount. In order to prevent the leakage of the waste ink, therefore, the capacity of the waste ink reservoir portion is set corresponding to the amount of the waste ink collected by the cartridge having the late exchange time. For this reason, the waste ink reservoir portion and the cartridge tend to be large-sized.

The invention has been made in consideration of the problems and has an object to provide a waste liquid collecting method, a liquid injecting apparatus and a cartridge (liquid housing) set which can reduce the size of the apparatus or the cartridge.

Moreover, it is an object of the invention to provide a waste liquid collecting method, a liquid injecting apparatus and a cartridge (liquid housing) set which can efficiently store a waste liquid in a plurality of liquid housings.

SUMMARY OF THE INVENTION

The invention provides a liquid housing comprising a liquid housing chamber accommodating a liquid to be supplied to a liquid injecting head and a waste liquid housing chamber accommodating an absorber for accommodating a waste liquid, wherein an air communicating hole for communicating with outside air is provided in the waste liquid housing chamber and the air communicating hole is sealed with an air permeable film.

According to the invention, the air communicating hole provided in the waste liquid housing chamber is sealed with the air permeable film. Therefore, the waste liquid can be prevented from leaking out of the air communicating hole. Moreover, the film sealing the air communicating hole is the air permeable film. When the waste liquid is introduced into the waste liquid housing chamber, therefore, a gas comes out of the air permeable film. Consequently, the waste liquid is smoothly introduced into the waste liquid housing chamber. Furthermore, the absorber accommodated in the waste liquid housing chamber absorbs and holds the waste liquid. Even if the posture of the liquid housing is changed, therefore, the waste liquid sticks to the air permeable film irrespective of a small amount of the waste liquid accommodated in the waste liquid housing chamber, and the air permeable film can be prevented from being unused, for example.

In the liquid housing according to the invention, the air permeable film is a liquid repellent air permeable film.

According to the invention, since the air permeable film is the liquid repellent air permeable film and repels the waste liquid because of the liquid repellency, the waste liquid sticks thereto with difficulty. Accordingly, the waste liquid can be prevented from sticking to the liquid repellent air permeable film to cause clogging, resulting in a deterioration in the air permeability.

In the liquid housing according to the invention, the liquid housing chamber accommodates a liquid in an accommodating state in a liquid housing bag.

According to the invention, the liquid in the accommodating state in the liquid housing bag is accommodated in the liquid housing chamber. For this reason, the liquid can be accommodated in a state in which a degree of deaeration is higher as compared with the case in which the liquid is not accommodated in the liquid housing bag but is directly accommodated in the liquid housing chamber, for example.

The liquid housing according to the invention comprises a vessel body and a cover member for blocking the vessel body, and the waste liquid housing chamber is divided by blocking the opening portion of the vessel body or the cover member with a film member.

According to the invention, the waste liquid housing chamber can easily be formed. Therefore, the waste liquid housing chamber can be formed at a low cost.

In the liquid housing according to the invention, the air communicating hole is formed on the cover member.

According to the invention, the air communicating hole is formed on the cover member. Therefore, air in the waste liquid housing chamber can easily be discharged to the outside of the liquid housing.

In the liquid housing according to the invention the air communicating hole is formed on the film member.

According to the invention, the air communicating hole is formed on the film member. Also when using a cover member having no air communicating hole formed thereon, for example, it is possible to discharge the air in the waste liquid housing chamber to the outside by means of the film member. Therefore, the waste liquid can be smoothly introduced into the waste liquid housing chamber.

The liquid housing according to the invention comprises a waste liquid introducing portion having a liquid flow path connected to the waste liquid housing chamber and causing the outer portion of the waste liquid housing chamber to communicate with the inner portion of the waste liquid housing chamber, and the waste liquid introducing portion is provided with a seal member capable of inserting a hollow needle for introducing a waste liquid into the waste liquid housing chamber.

According to the invention, the waste liquid introducing portion is provided with a seal member capable of inserting a hollow needle for introducing a waste liquid into the waste liquid housing chamber. Therefore, the sealing property of the waste liquid introducing portion and the hollow needle can be enhanced so that their connection can be carried out reliably.

In the liquid housing according to the invention, a valve mechanism for preventing a waste liquid from flowing out of the waste liquid introducing portion without the hollow needle inserted is provided on the inside of the waste liquid introducing portion.

According to the invention, a valve mechanism for preventing a waste liquid from flowing out of the waste liquid introducing portion without the hollow needle inserted is provided on the inside of the waste liquid introducing portion. When the hollow needle is not inserted into the waste liquid introducing portion, therefore, it is possible to prevent the waste liquid from leaking out of the waste liquid introducing portion.

A liquid injecting apparatus according to the invention comprises the liquid housing described above, and a liquid injecting head having a plurality of nozzles for discharging a liquid, a liquid supply tube connected to the liquid housing chamber, and a waste liquid tube connected to the waste liquid housing chamber, and the liquid is supplied from the liquid housing chamber to the liquid injecting head through the liquid supply tube, and furthermore, the liquid sucked from the liquid injecting head is discharged to the waste liquid housing chamber through the waste liquid tube.

According to the invention, it is possible to prevent the waste liquid from leaking out depending on the arrangement posture of the liquid injecting apparatus.

A liquid injecting apparatus according to the invention comprises a plurality of liquid housings described above, and a liquid injecting head having a plurality of nozzles for discharging a liquid, a plurality of liquid supply tubes connected to the liquid housing chambers, and a plurality of waste liquid tubes connected to the waste liquid housing chambers, and the liquid is supplied from the liquid housing chambers to the liquid injecting head through the liquid supply tubes respectively, and furthermore, the liquid sucked from the liquid injecting head is discharged to the waste liquid housing chambers through the waste liquid tubes.

According to the invention, the liquid is supplied from the liquid housing chambers to the recording head through the liquid supply tubes, and furthermore, the liquid sucked from the recording head is discharged to the waste liquid housing chambers through the waste liquid tubes. Therefore, the amount of the waste liquid which can be collected can be more increased as compared with the case in which the waste liquid housing chamber is provided in any of the liquid housings, for example. Furthermore, the waste liquid is collected into the waste liquid housing chamber in order from the lowest flow path resistance of the waste liquid tube connected to the waste liquid housing chamber, for example. As a result, the liquid injecting apparatus does not need to control the collection of the waste liquid in any of the liquid housings. Consequently, it is possible to reduce a time required for a liquid injection processing.

The invention provides a method of collecting a waste liquid in a liquid injecting apparatus comprising a liquid injecting head for discharging a liquid and a maintenance mechanism for sucking the liquid in the liquid injecting head, wherein there are provided a waste liquid reservoir portion for storing a waste liquid discharged from the maintenance mechanism in a plurality of cartridges for storing a liquid to be supplied to the liquid injecting head, an introducing portion for introducing the waste liquid into the waste liquid reservoir portion, and an open hole for discharging a gas in the waste liquid reservoir portion to an outside, and the flow path resistance of a cartridge side flow path from the introducing portion provided in any of the cartridges which has a large amount of consumption of the liquid to the open hole through the waste liquid reservoir portion is reduced and the amount of the waste liquid introduced in the waste liquid reservoir portion is set to be larger than that of the cartridge.

Consequently, the cartridge is provided with a cartridge side flow path constituted by the introducing portion, the waste liquid reservoir portion and the open hole. Moreover, the cartridge side flow path provided on the cartridge having a large amount of consumption of the liquid is formed in such a manner that a flow path resistance thereof is lower than that of each of the other cartridges.

Accordingly, the waste liquid discharged from the maintenance mechanism is easily introduced into the cartridge on the cartridge side flow path which has a low flow path resistance. As a result, the waste liquid filling rate of the cartridge is increased. More specifically, a waste liquid reservoir portion having a high waste liquid filling rate can be exchanged simultaneously with the exchange of a cartridge having a large amount of consumption of a liquid and an early exchange time. In other words, the waste liquid can be often discarded in a comparatively large amount. Therefore, the amount of the waste liquid to be stored in the waste liquid reservoir portion of each of the cartridges is lessened so that the capacity of the waste liquid reservoir portion can be reduced. Thus, the size of the cartridge can be reduced. Moreover, it is possible to vary the waste liquid filling rate of the cartridge with a simple structure without providing a control valve for controlling the flow of the waste liquid. Furthermore, the resistance of the flow path provided in the cartridge is varied. Consequently, it is possible to vary the waste liquid fling rate of each of the cartridges without changing the structure and layout of each member on the liquid injecting apparatus side.

The invention provides a liquid injecting apparatus comprising a liquid injecting head for discharging a liquid and a maintenance mechanism for sucking the liquid in the liquid injecting head, wherein a plurality of cartridges for storing a liquid to be supplied to the liquid injecting head includes a waste liquid reservoir portion for storing a waste liquid discharged from the maintenance mechanism respectively, and furthermore, flow path resistances of cartridge side flow paths from an introducing portion for introducing the waste liquid to an open hole for discharging a gas in the waste liquid reservoir portion to an outside through the waste liquid reservoir portion are different from each other.

Consequently, the cartridge side flow path constituted by the introducing portion, the waste liquid reservoir portion and the open hole is provided in the cartridge mounted on the liquid ejecting apparatus. Moreover, the cartridge side flow paths are formed in such a manner that the flow path resistances are different from each other. Accordingly, the waste liquid is easily introduced from the maintenance mechanism into the cartridge having a low flow path resistance of the cartridge side flow path so that the waste liquid filling rate can be increased. Therefore, when the flow path resistance of the cartridge side flow path of the cartridge having a large amount of consumption of the liquid and an early exchange time is reduced, for example, the waste liquid reservoir portion having a high waste liquid filling rate can be exchanged simultaneously with the exchange of the cartridge. In other words, the waste liquid can be often discarded in a comparatively large amount. Even if the capacity of each waste liquid reservoir portion is reduced, therefore, the waste liquid can be collected without a leakage. Accordingly, the sizes of the waste liquid reservoir portion and the cartridge can be reduced. Moreover, it is possible to vary the waste liquid filling rate of the cartridge with a simple structure without providing a control valve for controlling the flow of the waste liquid. Furthermore, the resistance of the flow path provided in the cartridge is varied. Consequently, it is possible to vary the waste liquid filling rate of each of the cartridges without changing the structure and layout of each member on the liquid ejecting apparatus side.

In the liquid injecting apparatus, the flow path sectional areas or flow path lengths of at least a part of the cartridge side flow paths provided in the cartridges are caused to be different from each other so that the flow path resistances of the cartridge side flow paths are caused to be different from each other.

Consequently, the flow path sectional areas or flow path lengths of at least a part of the cartridge side flow paths are different from each other so that the flow path resistances of the cartridge side flow paths are different from each other. More specifically, when the flow path sectional area is large or the flow path length is small, the flow path resistance is low. For this reason, it is possible to easily change the flow path resistances of the cartridge side flow paths by setting the cartridges to have almost the same structures.

In the liquid injecting apparatus, the flow path sectional areas or the flow path lengths from the introducing portions to the waste liquid reservoir portions in the cartridge side flow paths are different from each other.

Consequently, the flow path sectional areas or the flow path lengths from the waste liquid introducing ports to the waste liquid reservoir portions in the cartridge side flow paths are different from each other so that the flow path resistances are different from each other. Therefore, the structure of the flow path through which the waste liquid passes is varied depending on the cartridge. Consequently, it is possible to vary the flow path resistance reliably.

In the liquid injecting apparatus, the air permeabilities of the air permeable films provided in the cartridges to block the open holes are caused to be different from each other so that the flow path resistances of the cartridge side flow paths are caused to be different from each other.

Consequently, the flow-path resistance of each cartridge side flow path is varied by changing an air permeable amount (air permeability) per unit time of the air permeable film. Therefore, it is possible to easily vary the flow path resistance without changing the size or structure of the cartridge.

In the liquid injecting apparatus, the air permeable areas of the air permeable films are caused to be different from each other.

Consequently, the air permeable areas of the air permeable films are caused to be different from each other. Thus, the air permeabilities of the air permeable films are caused to be different from each other. More specifically, in the case in which the air permeable area of the air permeable film is large, a contact area with a gas in the waste liquid reservoir portion is increased. Therefore, the air permeability is great and the flow path resistance of the cartridge side flow path is low. Thus, it is possible to easily vary the flow path resistance without changing the size or structure of the cartridge.

In the liquid injecting apparatus, the thicknesses of the air permeable films are caused to be different from each other.

Consequently, the thicknesses of the air permeable films are caused to be different from each other. Thus, the air permeabilities of the air permeable films are caused to be different from each other. More specifically, in the case in which the thickness of the air permeable film is small, the air permeability is great and the flow path resistance of the cartridge side flow path is low. Thus, it is possible to easily vary the flow path resistance without changing the size or structure of the cartridge.

In the liquid injecting apparatus, the materials of the air permeable films are caused to be different from each other. Thus, the air permeabilities of the air permeable films are caused to be different from each other.

Consequently, the materials of the air permeable films are caused to be different from each other so that the air permeabilities of the air permeable films are different from each other. More specifically, in the case in which the air permeable film is formed by a material having a great air permeability, the flow path resistance of the cartridge side flow path is low. Therefore, it is possible to easily vary the flow path resistance without changing the size or structure of the cartridge.

In the liquid injecting apparatus, an exhaust flow path communicating with the waste liquid reservoir portion is provided in case of the cartridge and a plurality of air communicating portions which can be opened to the air in use is formed in the middle of the exhaust flow path. The air communicating portions are provided in such a manner that flow path lengths or flow path sectional areas from the waste reservoir portions to the air communicating portions are different from each other.

Consequently, the exhaust flow path communicating with the waste liquid reservoir portion is provided in case of the cartridge. Moreover, a plurality of air communicating portions which can be opened to the air in use is provided in the middle of the exhaust flow path. Furthermore, the air communicating portions are provided in such a manner that flow path lengths or flow path sectional areas from the waste liquid reservoir portions are different from each other. More specifically, in the case in which the air communicating portion which is comparatively close to the waste liquid reservoir portion is opened to the air, the flow path length from the waste liquid reservoir portion to the air communicating portion is reduced. Consequently, the flow path resistance is decreased. In the case in which the air communicating portion which is comparatively distant from the waste liquid reservoir portion is opened to the air, moreover, the flow path length from the waste liquid reservoir portion to the air communicating portion is increased. Consequently, the flow path resistance is increased. For this reason, in the case in which the exchange time of the cartridge is varied depending on the situation of use or the individual difference of an apparatus, for example, the flow path resistance of the cartridge can be changed properly.

The invention provides a cartridge set comprising a plurality of cartridges including a liquid reservoir portion for accommodating a liquid and a waste liquid reservoir portion for accommodating a waste liquid, wherein flow path resistances of cartridge side flow paths reaching open holes for discharging a gas in the waste liquid reservoir portion to an outside from introducing portions formed on the cartridges through the waste liquid reservoir portions are set to be different from each other depending on the amount of consumption of the liquid in each of the cartridges.

Consequently, each cartridge having the liquid reservoir portion and the waste liquid reservoir portion has the flow path resistance of the cartridge side flow path varied depending on the amount of consumption of the liquid. For this reason, the waste liquid can easily be introduced into the cartridge having a low flow path resistance so that the waste liquid filling rate of the cartridge can be increased. More specifically, it is possible to exchange the waste liquid reservoir portion having a high waste liquid filing rate simultaneously with the exchange of the cartridge having a large amount of consumption of a liquid and an early exchange time. In other words, the waste liquid can be often discarded in a comparatively large amount. Therefore, the amount of the waste liquid to be stored in the waste liquid reservoir portion of each of the cartridges is lessened so that the capacity of the waste liquid reservoir portion can be decreased. Consequently, the size of the cartridge can be reduced.

The present disclosure relates to the subject matter contained in Japanese patent application No. 2004-074982 (filed on Mar. 16, 2004) and 2004-217611 filed on Jul. 26, 2004), each of which is expressly incorporated herein by reference in its entirety.

DESCRIPTION OF THE PREFERRED EMBODIMENT

First Embodiment

A first embodiment carrying out the invention will be described below with reference to FIGS. 1 to 6.

Figure 1:
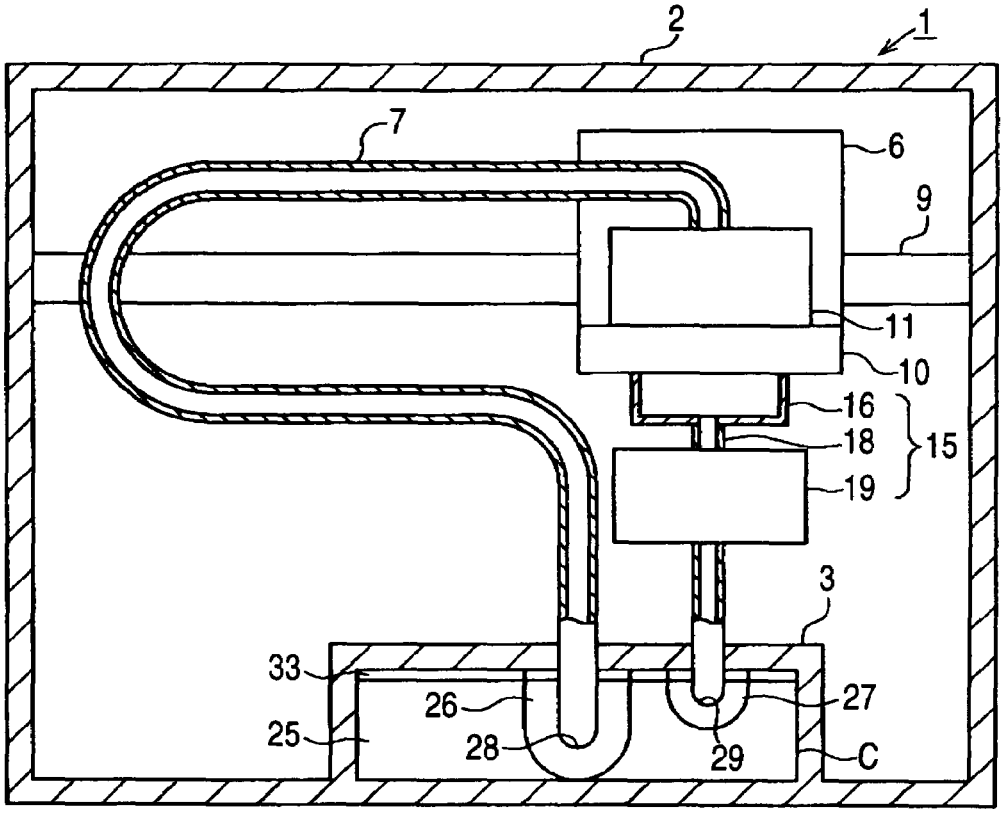
FIG. 1 is a conceptual view showing a printer.

FIG. 1 is a conceptual view showing a printer according to the embodiment.

As shown in FIG. 1, a printer 1 to be a liquid injecting apparatus comprises a cover 2, and a cartridge holder 3 is formed in the lower part of the cover 2. An ink cartridge C to be a liquid housing is removably provided in the cartridge holder 3. The ink cartridge C can accommodate an ink to be a liquid, and furthermore, can store a waste ink to be a waste liquid, details of which will be described below.

The printer 1 comprises a guide member 9, and the guide member 9 is provided over a pair of frames in the cover 2. A carriage 6 is inserted in and supported on the guide member 9 movably in the axial direction of the guide member 9. The carriage 6 is connected to a carriage motor (not shown) through a timing belt (not shown) and is reciprocated along the guide member 9 by the driving operation of the carriage motor.

A recording head 10 to be a liquid injecting head is provided on the lower surface of the carriage 6, and furthermore, a subtank 11 is mounted on the carriage 6. The subtank 11 is provided with a differential pressure regulating valve mechanism disclosed in EP1016533 and EP1398156. The subtank 11 is connected to the ink cartridge C through an ink supply tube 7 to be a liquid supply tube.

Moreover, the subtank 11 is connected to the recording head 10 and temporarily stores an ink supplied from the ink cartridge C, and supplies the ink to the recording head 10 with a pressure regulated. The recording head 10 includes, in a lower surface thereof, a nozzle which is not shown, and discharges, from the nozzle, the ink supplied from the subtank 11 by the driving operation of a piezoelectric unit which is not shown. At the same time that the ink is discharged from the nozzle, the carriage 6 is reciprocated with respect to a recording medium (not shown) to be a target so that printing can be carried out over the recording medium.

On the other hand, a maintenance mechanism 15 is provided in a non-printing region (a home position) placed on the right side of the cartridge holder 3 over the moving path of the carriage 6. As shown in FIG. 1, the maintenance mechanism 15 includes a cap 16 taking the shape of an almost square frame, and a sucking pump 19. While the sucking pump 19 is constituted by a tube pump in the example, another structure may be employed. The cap 16 can be moved vertically by well-known up-down means which is not shown. When the cap 16 is lifted, it abuts on the recording head 10, thereby sealing the nozzle of the recording head 10. Moreover, the cap 16 has a bottom portion to which a sheet-shaped sponge (not shown) is fastened. The sponge is opposed to the nozzle of the recording head 10 at a predetermined interval in the state in which the cap 16 abuts on the recording head 10, thereby receiving the ink discharged from the nozzle of the recording head 10. Furthermore, a discharge port is formed on the center of the cap 16 to penetrate through a bottom surface thereof.

A discharge flow path 18 formed by a waste liquid tube (a waste ink tube) has one of ends which is connected to the discharge port of the cap 16 and the other end which is connected to the ink cartridge C. The sucking pump 19 formed by a tube pump presses the waste ink tube 18 in a state in which the nozzle of the recording head 10 is sealed with the cap 16, thereby reducing a pressure in the cap 16 to suck the ink from the recording head 10 and to discharge the ink to the ink cartridge C.

Next, description will be given to the ink cartridge C.

Figure 2:
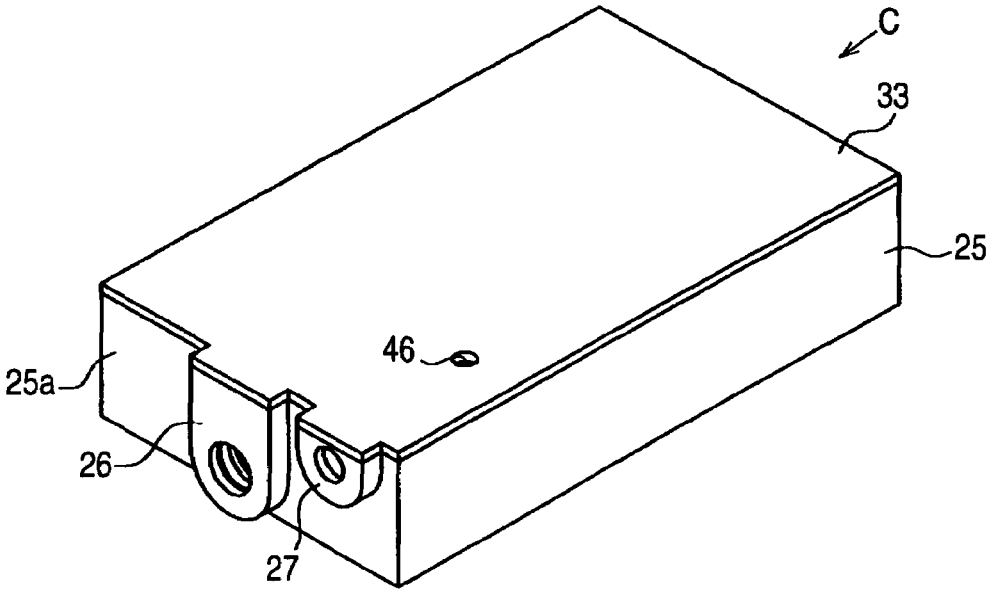
FIG. 2 is a perspective view showing an ink cartridge.
Figure 3:
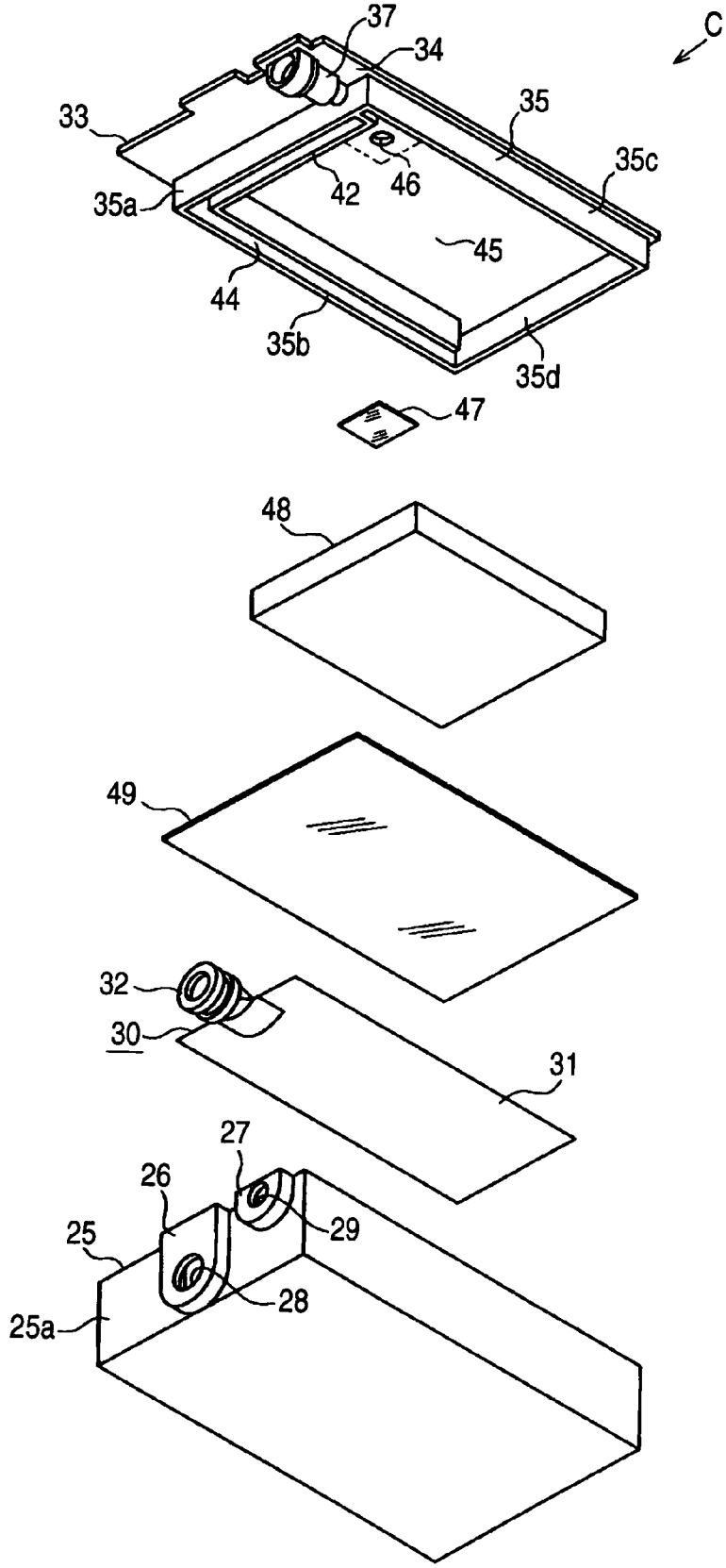
FIG. 3 is an exploded perspective view showing the ink cartridge.

As shown in FIG. 2, the ink cartridge C takes the shape of an almost rectangular parallelepiped. As shown in FIG. 3, the ink cartridge C includes an upper cover 33 to be a cover member, an air permeable or liquid repellent air permeable film 47, a waste ink absorber 48 to be an absorbing member, a film 49 to be a film member, an ink pack 30 to be a liquid housing bag, and a lower cover 25 to be a vessel body. The upper cover 33 has a rectangular plate-shaped portion 34 and an internal frame portion 35 erected at a right angle like a frame from the plate-shaped portion 34 in an inside position from the peripheral edge of the plate-shaped portion 34. The internal frame portion 35 has four side surfaces, that is, a first side surface (a front wall portion) 35*a*, a second side surface (a left wall portion) 35*b*, a third side surface (a right wall portion) 35*c*, and a fourth side surface (a back wall portion) 35*d*.

Figure 4:
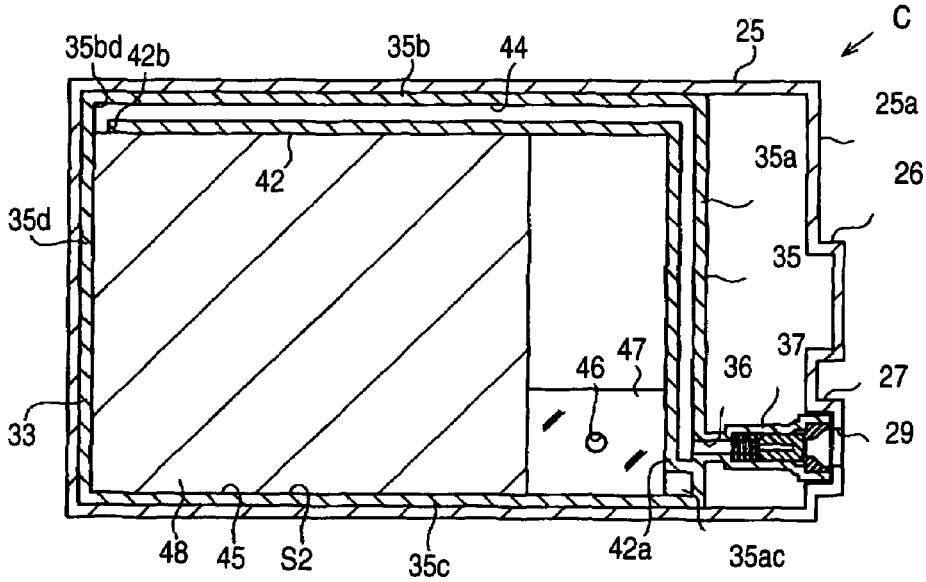
FIG. 4 is a sectional view showing the ink cartridge.

As shown in FIG. 4, a through hole 36 for causing the inside and outside of the first side surface 35*a* to communicate with each other is provided in the vicinity of a first corner portion 35*ac* formed by the first side surface 35*a* and the third side surface 35*c* in the internal frame portion 35. Moreover, a cylindrical waste liquid introducing portion 37 is protruded from the outside surface of the first side surface 35*a* to surround the through hole 36.

Figure 5:
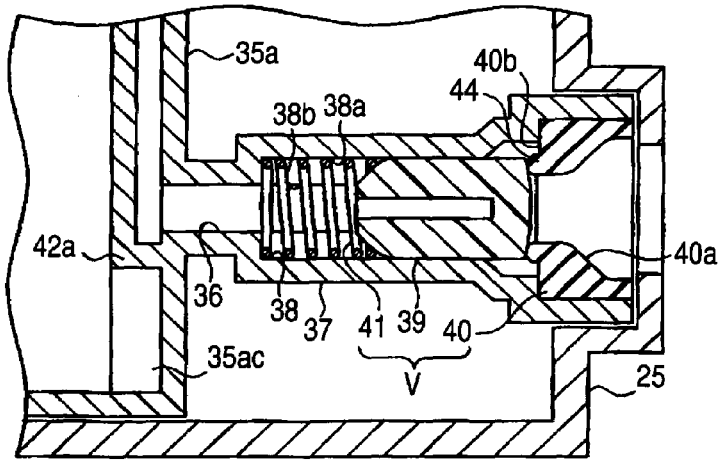
FIG. 5 is a partial sectional view showing the ink cartridge.

As shown in FIG. 5, a communicating hole 38 to be a liquid flow path is formed to penetrate through the waste liquid introducing portion 37. The communicating hole 38 communicates with the through hole 36. The communicating hole 38 is provided with a plurality of communicating grooves 38*b* on an inner peripheral surface 38*a*. The inner peripheral surface 38*a* is formed with a section taking an almost circular shape. The inner peripheral surface 38*a* is concaved to provide the communicating groove 38*b*. Herein, the communicating groove 38*b* is formed in two places of the inner peripheral surface 38*a*.

Moreover, a valve mechanism V is provided in the waste liquid introducing portion 87. The valve mechanism V includes a valve member 39 and a seal member (a valve seat) 40. The outside diameter of the valve member 39 is almost equal to the inside diameter of the inner peripheral surface 38*a*, and the inner peripheral surface 38*a* is provided slidably in the axial direction.

The seal member 40 is formed by a flexible material such as elastomer and is provided almost cylindrically. An insertion hole 40*a* penetrating through the center of the seal member 40 has an inside diameter on the valve member 39 side at which a waste liquid needle (not shown) to be a hollow needle provided in the waste ink tube 18 is close fitted, and is formed to be expanded and opened toward an introducing side (an outside). A valve seat portion 44 is protruded from a base end face 40*b* of the seal member 40 in order to surround the opening of the insertion hole 40*a*. The valve member 39 is seated on the valve seat portion 44 so that the insertion hole 40*a* of the seal member 40 is closed by the valve member 39. The waste liquid needle is formed to be hollow and the waste ink is caused to flow out through the hole.

Furthermore, the valve mechanism V includes a coiled spring 41 for energizing the valve member 39. The coiled spring 41 is supported and fixed into the communicating hole 38 in order to energize the valve member 39 toward the seal member 40 side. In the case in which a force is not applied from an outside, the coiled spring 41 is energized to press the valve member 89 in contact with the valve seat portion 44 of the seal member 40 as shown in FIG. 5. When the waste liquid needle is inserted into the valve member 39 through the insertion hole 40*a* of the seal member 40, the valve member 39 is moved in such a direction as to separate from the seal member 40 against the energizing force of the coiled spring 41. At this time, the tip of the waste liquid needle is inserted in a sealing state with the seal member 40. When the valve member 39 is separated from the seal member 40, moreover, the hole of the waste liquid needle, the communicating hole 38 on an opposite side with the valve member 39 interposed therebetween and the communicating groove 38*b* are connected to each other. When the waste ink of the waste liquid needle is introduced into the waste liquid introducing portion 87, accordingly, the waste ink is led through the communicating groove 38*b* to the communicating hole 88 on the coiled spring 41 side with the valve member 39 interposed therebetween and flows from the hole of the waste liquid needle into the internal frame portion 35.

As shown in FIG. 4, furthermore, the upper cover 33 includes an almost L-shaped dividing portion 42 on the inside of the internal frame portion 35 in parallel with the first side surface 35*a* and the second side surface 35*b*. The height of the dividing portion 42 is equal to that of the internal frame portion 35. Accordingly, a flow path 44 is formed by a division between the dividing portion 42 and the first side surface 35*a* and second side surface 35*b*. Moreover, a waste ink reservoir portion 45 taking the shape of an almost rectangular parallelepiped is formed by a division between the dividing portion 42 and the third side surface 35*c* and fourth side surface 35*d*.

The dividing portion 42 has an end 42*a* bonded in a close position to the first corner portion 35*ac* from the position of the through hole 36 with respect to the first side surface 35*a*. Moreover, the other end 42*b* of the dividing portion 42 is positioned so as not to come in contact with the internal frame portion 35 in a second corner portion 35*bd* formed by the second side surface 35*b* and the fourth side surface 35*d*. Accordingly, the flow path 44 communicates with the through hole 36 in the vicinity of the first corner portion 35*ac*, and furthermore, communicates with the waste ink reservoir portion 45 in the vicinity of the second corner portion 35*bd* opposed to the first corner portion 35*ac*. As a result, when the waste ink flows into the internal frame portion 35 via the through hole 36, it is moved in the flow path 44 along the first side surface 35*a* and the second side surface 35*b* and flows into the waste ink reservoir portion 45 in the second corner portion 35*bd*.

Furthermore, an air communicating hole 46 is formed to penetrate through the upper cover 33 in a position opposed to the through hole 36 with the dividing portion 42 of the waste ink reservoir portion 45 interposed therebetween. Consequently, air sucked from the recording head 10 together with the waste ink and discharged to the waste ink reservoir portion 45 can be discharged to an outside. Moreover, the air communicating hole 46 is positioned in the most distant place from the second corner portion 35*bd* in the waste ink reservoir portion 45.

The square film 47 is stuck to the air communicating hole 46 from the inside of the upper cover 33 as shown in FIG. 3. In the example, the film 47 has a liquid repellency and an air permeability. Although the liquid repellent air permeable film 47 prevents the waste ink from passing therethrough, accordingly, the air sucked from the recording head 10 together with the waste ink can be discharged to the outside of the ink cartridge C. In addition, the film 47 has a liquid repellency, and therefore, the waste ink is repelled and thus sticks thereto with difficulty.

The waste ink absorber 48 is formed by a porous material, and takes the shape of an almost rectangular parallelepiped and has such a thickness and width as to be exactly fitted in the waste ink reservoir portion 45 of the upper cover 33 as shown in FIG. 3. The waste ink absorber 48 is formed to have such a length as not to overlap with the film 47. As shown in FIG. 4, the waste ink absorber 48 is accommodated in the waste ink reservoir portion 45.

Figure 6:
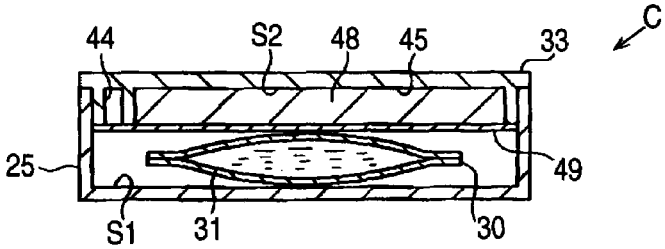
FIG. 6 is a sectional view showing the ink cartridge.

As shown in FIG. 3, the film 49 takes a rectangular shape and is formed by a double film such as polystyrene and nylon in the case in which the upper cover 33 is polystyrene, for example. The film 49 has a peripheral edge portion welded thermally to the internal frame portion 35 so that the inside of the internal frame portion 35 is sealed. The film 49 is also welded thermally to the dividing portion 42. As shown in FIG. 6, accordingly, the opening of a groove-shaped space between the internal frame portion 35 and the dividing portion 42 is sealed with the film 49 so that the flow path 44 is formed. Moreover, the waste ink reservoir portion 45 has the opening sealed with the film 49 in a state in which the waste ink absorbent 48 is accommodated so that a waste ink reservoir chamber S2 to be a waste liquid housing chamber is formed.

As shown in FIG. 3, the ink pack 30 includes an ink bag 31 and an ink outlet 32. The ink bag 31 is formed by a flexible material and is constituted by an aluminum laminate film having a structure in which an outside is interposed by a nylon film and an inside is interposed by a polyethylene film in order to enhance a gas barrier property, for example. The ink bag 31 is formed by superposing two aluminum laminate films taking an almost rectangular shape and bonding their peripheries by a method of thermal welding, and accommodates a deaerated ink therein.

The ink outlet 32 includes a cylinder portion formed of plastic constituted by the same material as the inner film of the ink bag 31, for example. The cylinder portion is attached to a part of the bonding portion of the two aluminum laminate films of the ink bag 31 by the method of thermal welding, and is fixed in such a manner that the ink in the ink bag 31 can be led to an outside. Moreover, the ink outlet 32 includes a valve mechanism (not shown) therein. The valve mechanism has the same structure as the valve mechanism V provided in the waste liquid introducing portion 37.

The lower cover 25 is box-shaped in which an upper side taking the shape of an almost rectangular parallelepiped is opened, and has such a size that the internal frame portion 35 of the upper cover 33 can be inserted therein. A side surface (front wall portion) 25*a* is provided with a lead-out portion 26 and a lead-in portion 27. The lead-out portion 26 and the lead-in portion 27 are formed as a first protrusion and a second protrusion which are outward protruded from the font wall portion 25*a*. The first and second protrusions have lower parts taking the shape of a circular arc, respectively.

The ink outlet 32 of the ink pack 30 can be fitted in the lead-out portion 26, and the ink pack 30 is accommodated in the lower cover 25 by fitting the ink outlet 32 in the lead-out portion 26. Moreover, a hole 28 is formed to penetrate through the lead-out portion 26 in an opposed position to the ink outlet 32 of the ink pack 30.

Moreover, the waste liquid introducing portion 37 of the upper cover 33 can be fitted in the lead-in portion 27 and the waste liquid introducing portion 37 of the upper cover 33 is fitted in the lead in portion 27 so that the opening of the lower cover 25 is sealed. Moreover, a hole 29 is formed to penetrate through the lead-in portion 27 in an opposed position to the waste liquid introducing portion 37 of the upper cover 33.

When the ink cartridge C is assembled as shown in FIGS. 3 and 6, accordingly, the ink pack 30 is first accommodated in the lower cover 25. Then, the film 47 is stuck to the air communicating hole 46 to accommodate the waste ink absorber 48 in the upper cover 33, thereby sealing an opening to be the opening portion of the upper cover 33 with the film 49. The upper cover 33 is inserted into the lower cover 25, thereby sealing the opening of the lower cover 25. The opening of the lower cover 26 is sealed with the upper cover 33 so that an ink housing chamber S1 to be a liquid housing chamber is formed. Therefore, the ink pack 30 is accommodated in the ink housing chamber S1. The lower cover 25 is provided with an air communicating hole or an air communicating path (not shown) which serves to cause the ink housing chamber S1 to communicate with the air.

The ink supply tube 7 is connected through the hole 28 to the ink pack 30 of the ink cartridge C. In detail, the ink supply tube 7 includes a hollow ink supply needle (not shown) on an end thereof, and the ink supply needle opens the valve mechanism provided in the ink outlet 32 of the ink pack 30 so that the ink pack 30 and the ink supply tube 7 are connected to each other.

Moreover, the waste liquid introducing portion 37 of the ink cartridge C is connected to the waste ink tube (discharge flow path) 18 through the hole 29. In detail, the hollow waste liquid needle (not shown) provided on the end of the waste ink tube 18 opens the valve mechanism V provided in the waste liquid introducing portion 37 to communicate with the flow path 44. Consequently, the waste ink absorber 48 and the waste ink tube 18 are connected to each other.

Next, description will be given to the function of the printer 1 constituted as described above.

It is assumed that the printer 1 is carried or brought down so that the posture of the ink cartridge C is changed. At this time, even if the waste ink is sucked into the waste ink reservoir chamber S2 through the flow path 44, the waste ink is absorbed and held by the waste ink absorber 48 in which the upper cover 33 is fitted. Therefore, the waste ink does not flow into the space of the waste ink reservoir chamber S2, that is, the space facing the air communicating hole 46. Accordingly, the waste ink can be prevented from flowing into the space to adhere to the film 47 stuck to the air communicating hole 46 until the waste ink absorber 48 is sufficiently filled with the waste ink.

Moreover, the air communicating hole 46 is positioned in the most distant place from the second corner portion 35*bd* in the upper cover 83. Also when the waste ink is sucked from the flow path 44 and is absorbed and held in the waste ink absorber 48, consequently, the waste ink is not soaked out to the vicinity of the film 47 before the waste ink is absorbed and held in a maximum amount in which the waste ink absorber 48 can be absorbed and held. Accordingly, the waste ink sticks to the film 47 with difficulty.

Furthermore, the air communicating hole 46 is sealed with the liquid repellent air permeable film 47. Even if the waste ink absorber 48 absorbs and holds the waste ink in a maximum amount which can be absorbed and held. Even if the waste ink is soaked out of the waste ink absorber 48, the waste ink can be prevented from leaking out of the ink cartridge C through the air communicating hole 46. In addition, the liquid repellent air permeable film 47 repels the waste ink so that the waste ink sticks thereto with difficulty. As a result, it is possible to prevent a liquid repellent air permeable film F from being clogged with the waste ink, resulting in a deterioration in the air permeability.

According to the embodiment, it is possible to obtain the following advantages.

(1) In the embodiment, the air communicating hole 46 is provided in the distant place from the second corner portion 35*bd* of the upper cover 33 of the ink cartridge C, that is, the opposed place to the through hole 36 with the end 42*a* of the dividing portion 42 interposed therebetween, and the film 47 is stuck to the air communicating hole 46. The waste ink absorber 48 is fitted in the upper cover 33. As a result, when the printer 1 is carried or brought down so that the posture of the ink cartridge C is changed, the waste ink is absorbed and held by the waste ink absorber 48 even if the waste ink is sucked from the flow path 44. When the waste ink is not sufficiently collected into the waste ink reservoir chamber S2, accordingly, it can be prevented from reaching the film 47 stuck to the air communicating hole 46 to deteriorate the air permeability of the film 47.

(2) In the embodiment, the air communicating hole 46 is positioned in the most distant place from the second corner portion 35*bd* in the upper cover 33. Also when the waste ink is sucked from the flow path 44 by a change in the posture of the ink cartridge C and is absorbed and held in the waste ink absorber 48, consequently, the waste ink is not soaked out to the vicinity of the film 47 until the waste ink is absorbed and held in the maximum amount in which the waste ink can be absorbed and held by the waste ink absorber 48. Accordingly, the waste ink can be prevented from reaching the film 47 to deteriorate the air permeability of the film 47.

(3) In the embodiment, the air communicating hole 46 is provided in the opposed place to the second corner portion 35*bd* of the upper cover 33 of the ink cartridge C, that is, the opposed peace to the through hole 36 with the end 42*a* of the dividing portion 42 interposed therebetween, and the liquid repellent air permeable film 47 is stuck to the air communicating hole 46. As a result, the waste ink absorber 48 absorbs and holds the waste ink in a maximum amount which can be absorbed and held, and the waste ink can be prevented from leaking out of the air communicating hole 46 even if it is soaked out of the waste ink absorber 48. When the waste ink is introduced into the waste ink reservoir chamber S2, moreover, the air comes out of the liquid repellent air permeable film 47. Therefore, the waste ink is smoothly introduced into the waste ink reservoir chamber S2. In addition, the liquid repellent air permeable film 47 repels the waste ink, and therefore, the waste ink sticks thereto with difficulty. Consequently, the liquid repellent air permeable film 47 can be prevented from being clogged with the waste ink to deteriorate the air permeability.

Second Embodiment

Next, a second embodiment carrying out the invention will be described with reference to FIG. 7. One of features according to the embodiment is that a plurality of ink cartridges C described in the first embodiment is connected. In the following embodiment, the same portions as those in the first embodiment have the same reference numerals and detailed description thereof will be omitted.

Figure 7:
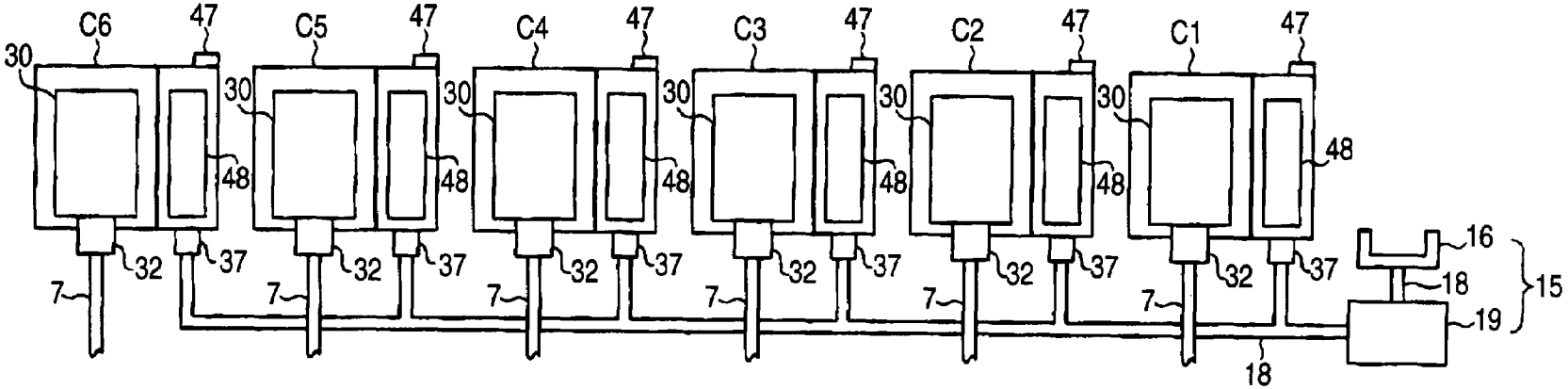
FIG. 7 is a conceptual view showing a waste ink collecting system according to a second embodiment.

FIG. 7 is a conceptual view showing a waste liquid collecting system in which a plurality of ink cartridges is connected.

In the embodiment, the waste liquid collecting system comprises ink cartridges C1, C2, C3, C4, C5 and C6 corresponding to six ink colors (black, cyan, magenta, yellow, light cyan and light magenta), for example. Moreover, the waste liquid collecting system comprises a maintenance mechanism 15. In the case in which the description is to be given without the distinction of these ink cartridges C1 to C6 from each other, they will be hereinafter referred to as a cartridge C in the same manner as in the first embodiment.

The ink cartridges C1, C2, C3, C4, C5 and C6 are provided in this order from a close side to a sucking pump 19, for example. Waste liquid introducing portions 37 of the respective ink cartridges C1 to C6 are connected to each other through a waste ink tube (a discharge flow path) 18, and furthermore, are connected to the pump 19 through the waste ink tube 18. More specifically, the six ink cartridges C1 to C6 are connected to the pump 19 in parallel.

In the waste ink tubes 18 connected to the ink cartridges C1 to C6, moreover, flow path sectional areas are equal to each other and only path lengths from the pump 19 are different from each other. Air communicating holes 46 of the ink cartridges C1 to C6 are not connected to each other but communicate with the outside air independent of each other. Moreover, ink outlets 32 of the ink cartridges C1 to C6 are connected to each other but are connected to ink supply tubes 7 corresponding thereto. An air permeable film 47, preferably, a liquid repellent air permeable film 47 is stuck to each of the air communicating holes 46 of the ink cartridges CL to C6.

Next, description will be given to the function of the waste liquid collecting system thus constituted.

When the maintenance mechanism 15 of a printer 1 first carries out a cleaning operation, an ink sucked into the pump 19 is discharged to the waste liquid introducing portion 37 of the ink cartridge C1 which is the closest to the pump 19 and has the smallest flow path length of the waste ink tube 18, that is, the lowest flow path resistance of the waste ink tube 18 through the waste ink tube 18. It is assumed that the cleaning is carried out many times and the waste ink is absorbed and held in a maximum amount which can be absorbed and held by a waste ink absorber 48 provided in the ink cartridge C1.

When the ink cartridge C1 which is the closest to the pump 19 is filled with a waste ink, the waste ink discharged from the maintenance mechanism 15 is discharged to the waste liquid introducing portion 37 of the ink cartridge C2 having the second smallest flow path length and flow path resistance of the waste ink tube 18 to the ink cartridge C1. The waste ink is discharged to the ink cartridge C2 as described above until the waste ink absorber 48 of the ink cartridge C2 is filled with the waste ink.

Similarly, the waste ink discharged from the maintenance mechanism 15 is discharged to the ink cartridge C3 having the second smallest flow path length and flow path resistance of the waste ink tube 18 to the ink cartridge C2. Thus, the waste ink is collected in order of the ink cartridges C4, C5 and C6.

Consequently, it is possible to more increase the amount of the waste ink which can be collected as compared with the case in which a waste ink reservoir chamber S2 is provided in only one of the ink cartridges C1 to C6 corresponding to the inks having the six colors, for example. Moreover, the waste ink is collected into each of the ink cartridges C in ascending order from the flow path resistance of the waste ink tube 18 connected to the ink cartridge C. Therefore, the printer 1 does not need to carry out a control for collecting the waste ink by the waste ink reservoir chamber S2 of the ink cartridge C accommodating an ink having any color. Accordingly, it is possible to reduce a time required for the print processing of the printer 1.

By more reducing the flow path resistance of the waste ink tube 18 connected to the ink cartridge C having a higher exchange frequency, moreover, it is possible to collect the waste ink into the ink cartridge C having a higher exchange frequency with more priority. Accordingly, it is possible to efficiently collect the waste ink even if the volume of the waste ink reservoir chamber S2 of each of the ink cartridges C is decreased.

According to the embodiment, it is possible to obtain the following advantages in addition to the advantages of the first embodiment.

(1) In the embodiment, the six ink cartridges C1 to C6 are connected to the pump 19 through the waste ink tube 18 in parallel. For example, therefore, it is possible to more increase the amount of the waste ink which can be collected as compared with the case in which the waste ink reservoir chamber S2 is provided in one of the ink cartridges C.

(2) In the embodiment, the six ink cartridges C1 to C6 are connected to the pump 19 through the waste ink tube 18 in parallel. Therefore, the waste ink is collected into each of the ink cartridges C1 to C6 in ascending order of the flow path resistance of the waste ink tube 18 connected to the ink cartridges C1 to C6. As a result, the printer 1 does not need to carry out a control for collecting the waste ink into the ink cartridges C1 to C6 accommodating the inks having the respective colors. Accordingly, it is possible to reduce a time required for the print processing of the printer 1.

(3) By more reducing the flow path resistance of the waste ink tube 18 connected To the ink cartridge C having a higher exchange frequency, it is possible to collect the waste ink into the ink cartridge C having a higher exchange frequency with more priority. Accordingly, it is possible to efficiently collect the waste ink even if the volume of the waste ink reservoir chamber S2 of each of the ink cartridges C is decreased.

Third Embodiment

Figure 8:
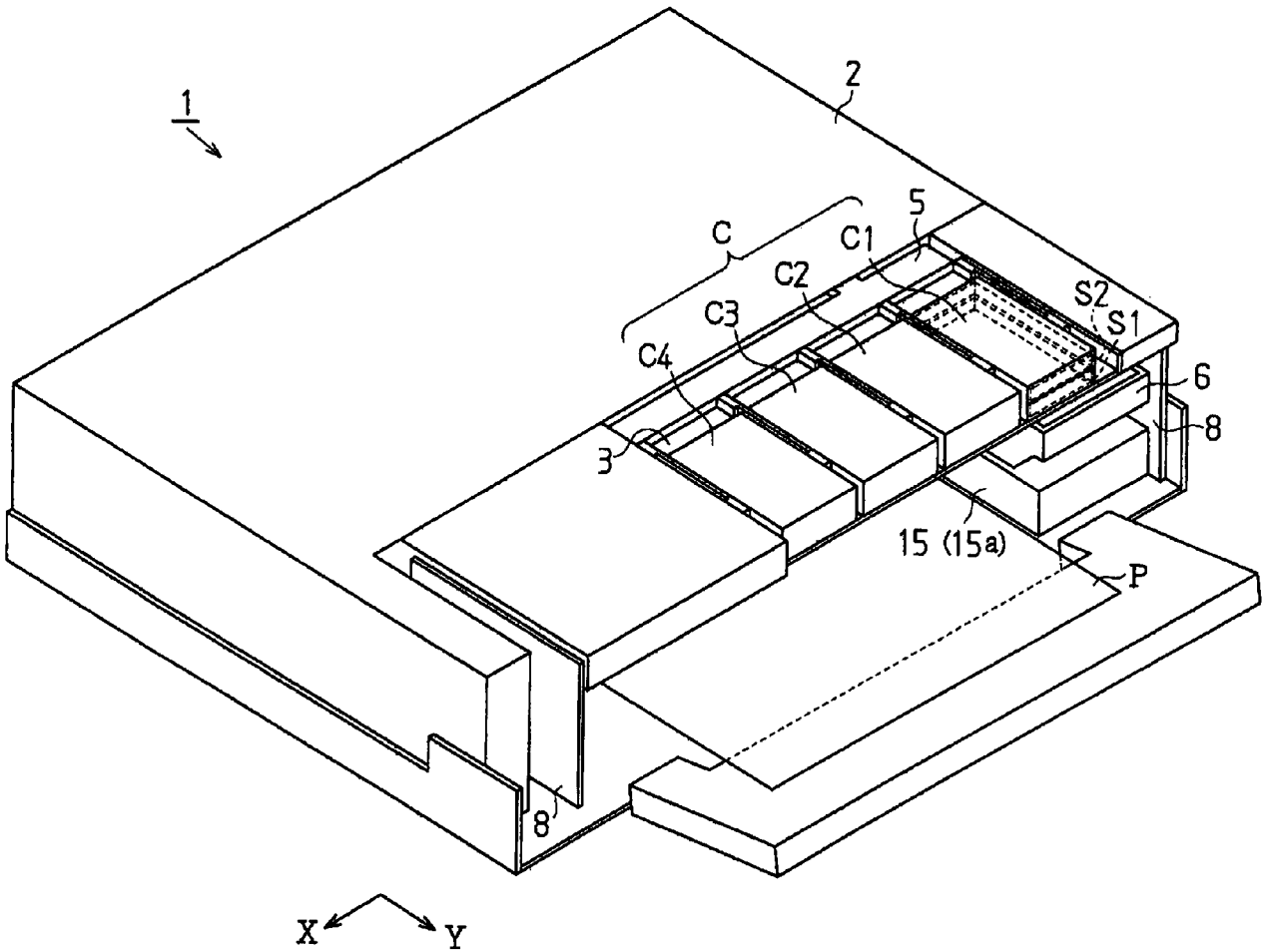
FIG. 8 is a perspective view showing another printer.
Figure 9:
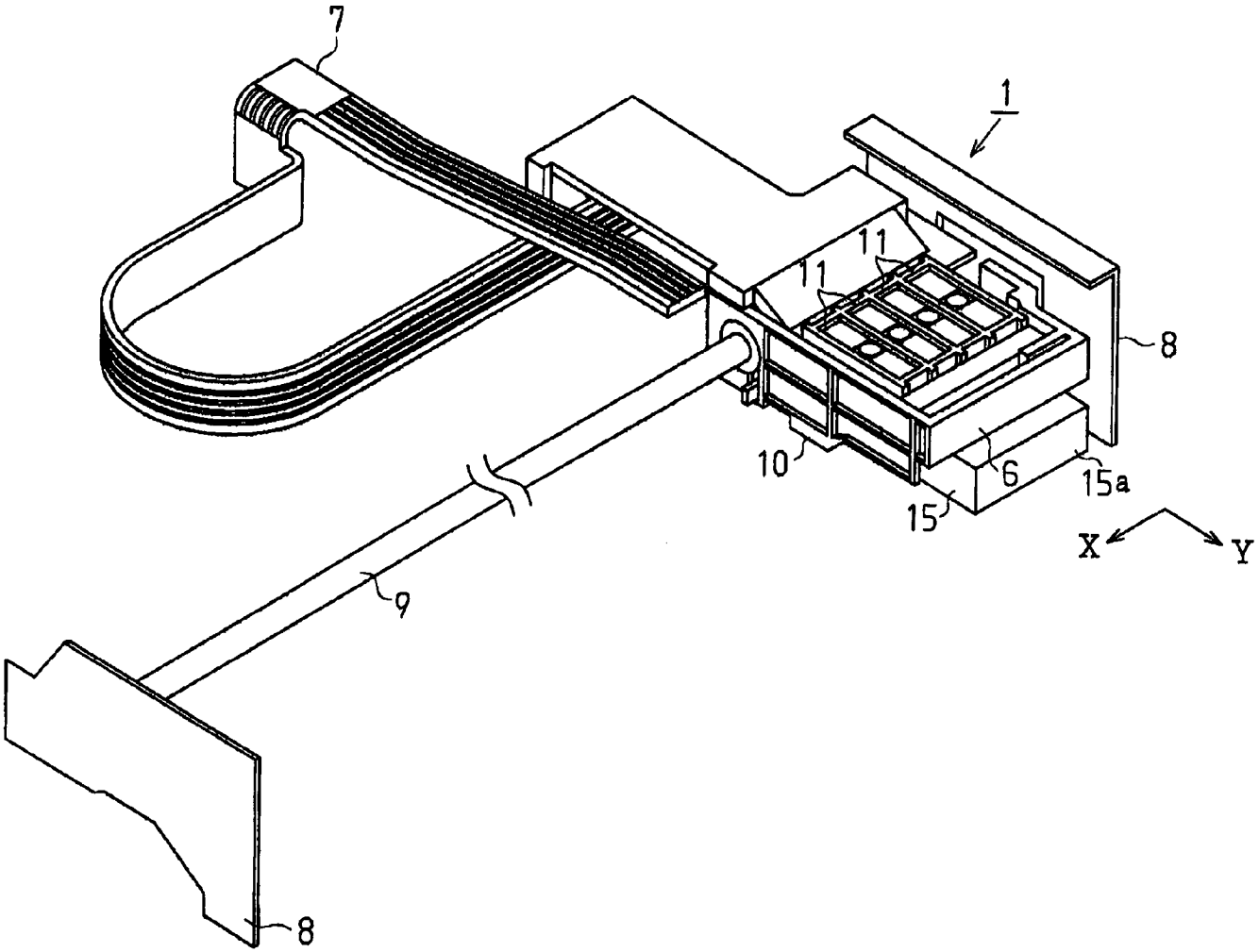
FIG. 9 is a perspective view showing the main part of the printer in FIG. 8.
Figure 10:
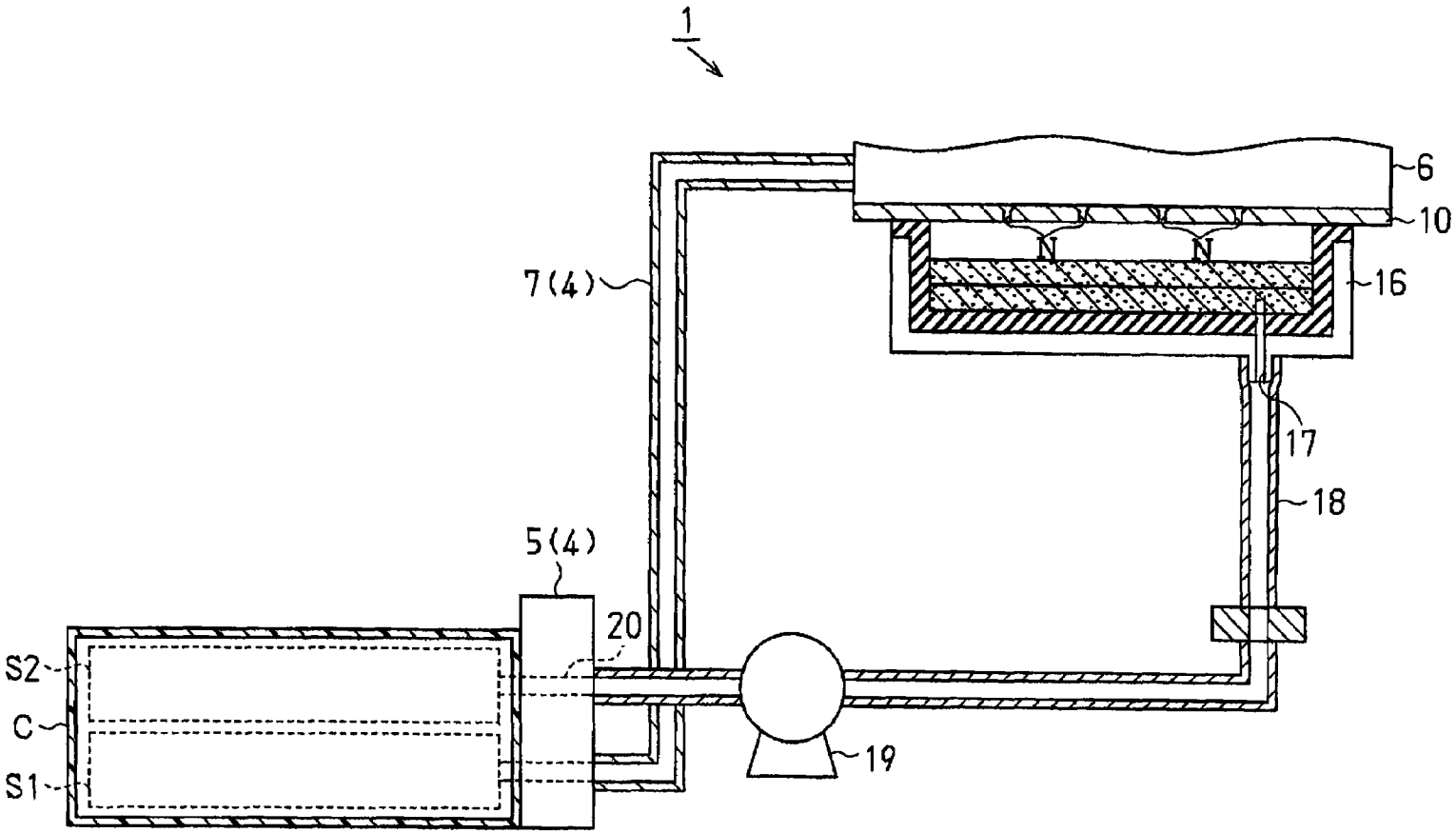
FIG. 10 is a typical view for explaining the cleaning operation of the printer in FIG. 8.
Figure 11:
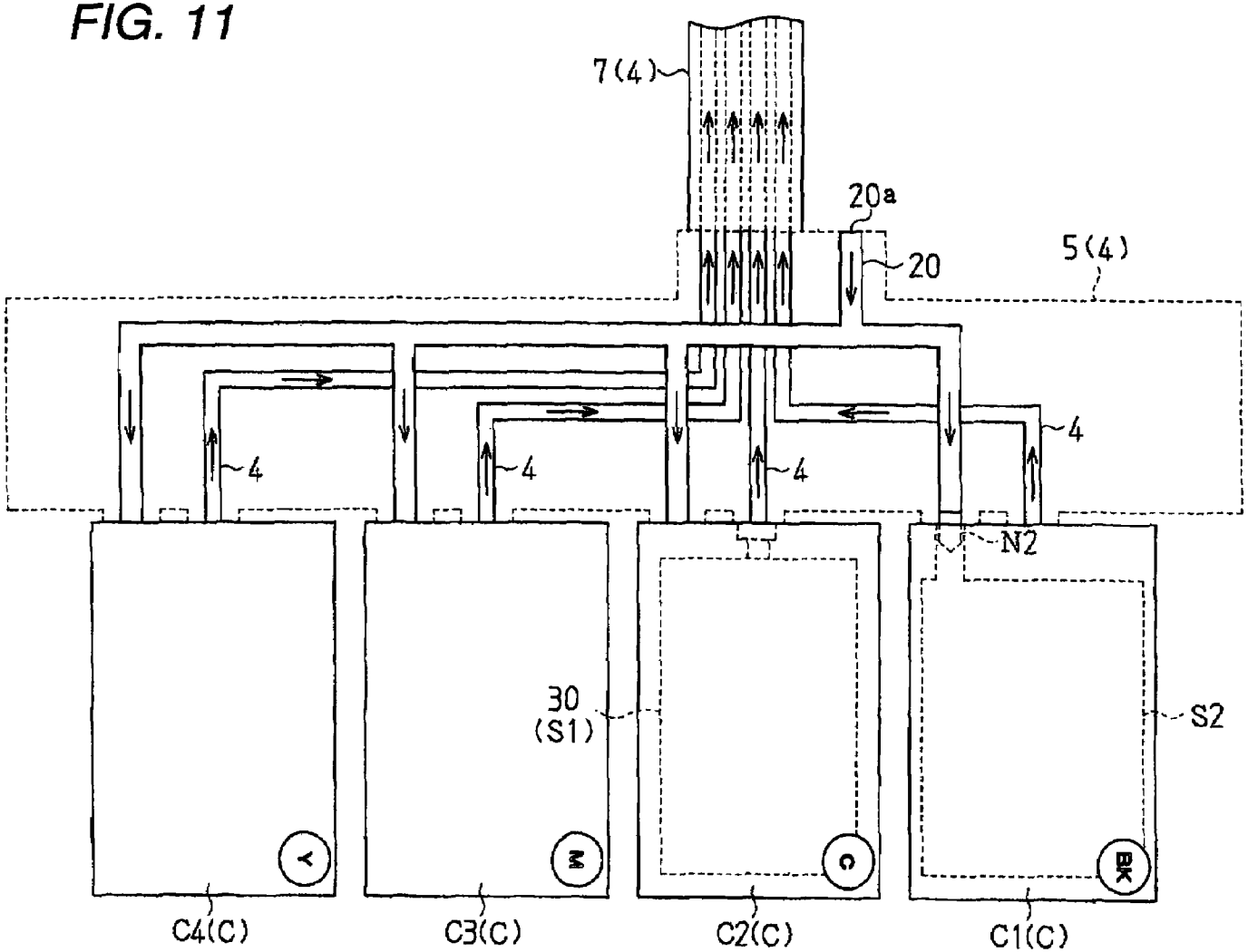
FIG. 11 is an explanatory view showing the flow of an ink and a waste ink to a cartridge in the printer of FIG. 8.

A third embodiment carrying out the invention will be described below with reference to FIGS. 8 to 16. FIG. 8 is a perspective view showing a printer 1 to be a liquid injecting apparatus, FIG. 9 is a perspective view showing the main part of the printer 1, FIG. 10 is a typical view for explaining the cleaning operation of the printer 1, and FIG. 11 is an explanatory view showing the flow of an ink to be a liquid and a waste ink to be a waste liquid for a cartridge C. The same portions as those in the first and second embodiments have the same reference numerals and detailed description thereof will be omitted. One of features according to the embodiment is that a flow path resistance to the waste liquid in at least one of the ink cartridges C attached to the printer 1 is set to be lower than a flow path resistance for the waste liquid in another ink cartridge.

As shown in FIG. 8, the printer 1 comprises a cartridge holder 3 on the upper surface of a cover 2. First to fourth cartridges C1 to C4 are removably attached to the cartridge holder 3, respectively. The first to fourth cartridges C1 to C4 are arranged in the cartridge holder 3 in a line in order. An elongated connecting portion 5 is provided adjacently to the cartridge holder 3. When the first to fourth cartridges C1 to C4 are attached to the cartridge holder 3, they are connected to a coupling part (not shown) in the connecting portion 5.

As shown in a broken line in the first cartridge C1 on a right end in FIG. 8, moreover, the first to fourth cartridges C1 to C4 have a first housing portion S1 to be a liquid reservoir portion for accommodating various inks therein. The first cartridge C1 accommodates a black ink in the first housing portion S1 and the second to fourth cartridges C2 to C4 accommodate various color inks of cyan, magenta and yellow therein, respectively.

Moreover, the first to fourth cartridges C1 to C4 include a second housing portion S2 capable of accommodating a liquid as shown in a broken line above the first housing portion S1 in inner parts thereof A waste ink discharged in the cleaning to be carried out for preventing a printing failure by the printer 1 is accommodated in the second housing portion S2. In the case in which description is to be given without the distinction of the first to fourth cartridges C1 to C4 from each other, they will be simply referred to as the cartridge C. Moreover, the first to fourth cartridges C1 to C4 constitute a cartridge set.

As shown in FIGS. 10 and 11, each supply flow path 4 for causing each cartridge C to communicate with a carriage 6 is connected to the cartridge C. The supply flow path 4 is constituted by a flow path (not shown) which is formed in the connecting portion 5 and a supply tube 7 (see FIG. 9) coupled to the connecting portion 5. The supply tube 7 has one of ends which is connected to the connecting portion 5 and the other end which is coupled to the carriage 6 side, and includes four supply flow paths 4.

As shown in FIG. 9, the carriage 6 is inserted in and supported on a guide member 9 provided across a pair of frames 8 in the cover 2. The carriage 6 is driven and coupled to a carriage motor (not shown) through a timing belt and is reciprocated in a fast scan direction (an X-axis direction) along the guide member 9 by the driving operation of the carriage motor.

A recording head 10 to be a liquid injecting head is provided on the lower surface of the carriage 6. The recording head 10 includes a piezoelectric unit (not shown) and each nozzle N (see FIG. 3). Moreover, four subtanks 11 are mounted on the carriage 6 as shown in FIG. 9 and an ink supplied from each cartridge C through the supply flow path 4 (the connecting portion 5 and the supply tube 1) is temporarily stored in each of the subtanks 11. Each of the subtanks 11 supplies an ink to the recording head 10 corresponding to the amount of the ink discharged from the recording head 10. Accordingly, printing is carried out by alternately repeating an operation for discharging an ink droplet to a paper P (see FIG. 8) while moving the recording head 10 in the fast scan direction and an operation for delivering the paper P in a slow scan direction (a Y-axis direction) by means of a paper feeding mechanism which is not shown. In the printer 1, moreover, it is assumed to previously know, according to statistics, that the black ink has the largest amount of consumption of an ink (a liquid). For this reason, an exchange time for the first cartridge C1 is the earliest.

Moreover, a maintenance mechanism 15 is provided in the home position of the carriage 6 shown in FIG. 9 in a non-printing region to be a moving path for the carriage 6 on the outside of a delivery path for the paper P. The maintenance mechanism 15 includes, in a case 15*a*, a cap 16 taking the shape of a square frame shown in FIG. 10. The cap 16 is reciprocated in a vertical direction by an up-down mechanism (not shown) between an acting position abutting on the lower surface of the recording head 10 shown in FIG. 10 and an evacuating position separated from the recording head 10. Moreover, a discharge port 17 is formed to penetrate through the bottom wall of the cap 16 and a discharge flow path 18 such as a tube is connected to the discharge port 17. The discharge flow path 18 connects the cap 16 to the connecting portion 5 and a sucking pump 19 is provided in the middle thereof.

In suction cleaning, the cap 16 is disposed in the acting position and the sucking pump 19 is driven with the lower surface of the recording head 10 sealed. Consequently, air and an ink are sucked and discharged from the discharge flow path 18 and the cap 16, and a negative pressure is accumulated in the cap 16. By the action of the negative pressure, a thickened ink, dust and air bubbles are discharged from the nozzle N of the recording head 10 and the lower surface thereof into the cap 16.

The ink discharged into the cap 16 is transmitted by pressure through the sucking pump 19 to a waste ink flow path 20 communicating with the discharge flow path 18. The waste ink flow path 20 is formed in the connecting portion 5 as shown in FIG. 10. Moreover, the waste ink flow path 20 is formed to branch in the direction of each cartridge C in the middle as shown in FIG. 11. By this structure, the waste ink flowing into the waste ink flow path 20 is distributed and stored in the second housing portion S2 of each cartridge C. Referring to each flow path length from an inlet 20*a* of the waste ink flow path 20 to the inlet of each cartridge C, moreover, flow path lengths d1 and d2 communicating with the first and second cartridges C1 and C2 are equal to the path length and flow path lengths d3 and d4 communicating with the third and fourth cartridges C3 and C4 are greater than the path length (that is, $d1=d2<d3<d4$).

Figure 12:
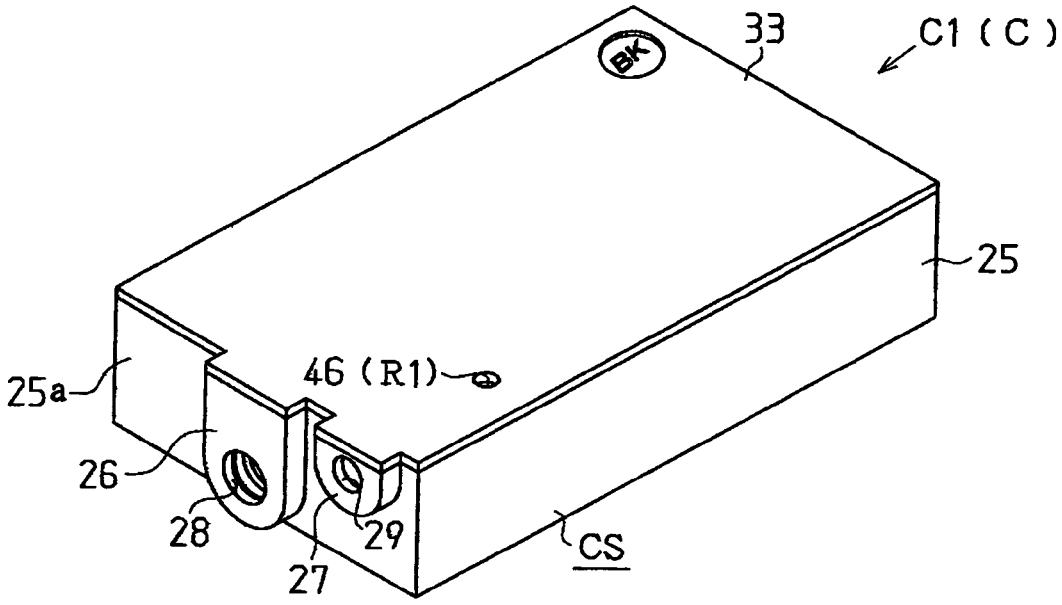
FIG. 12 is a perspective view showing a cartridge to be attached to the printer in FIG. 8.
Figure 13:
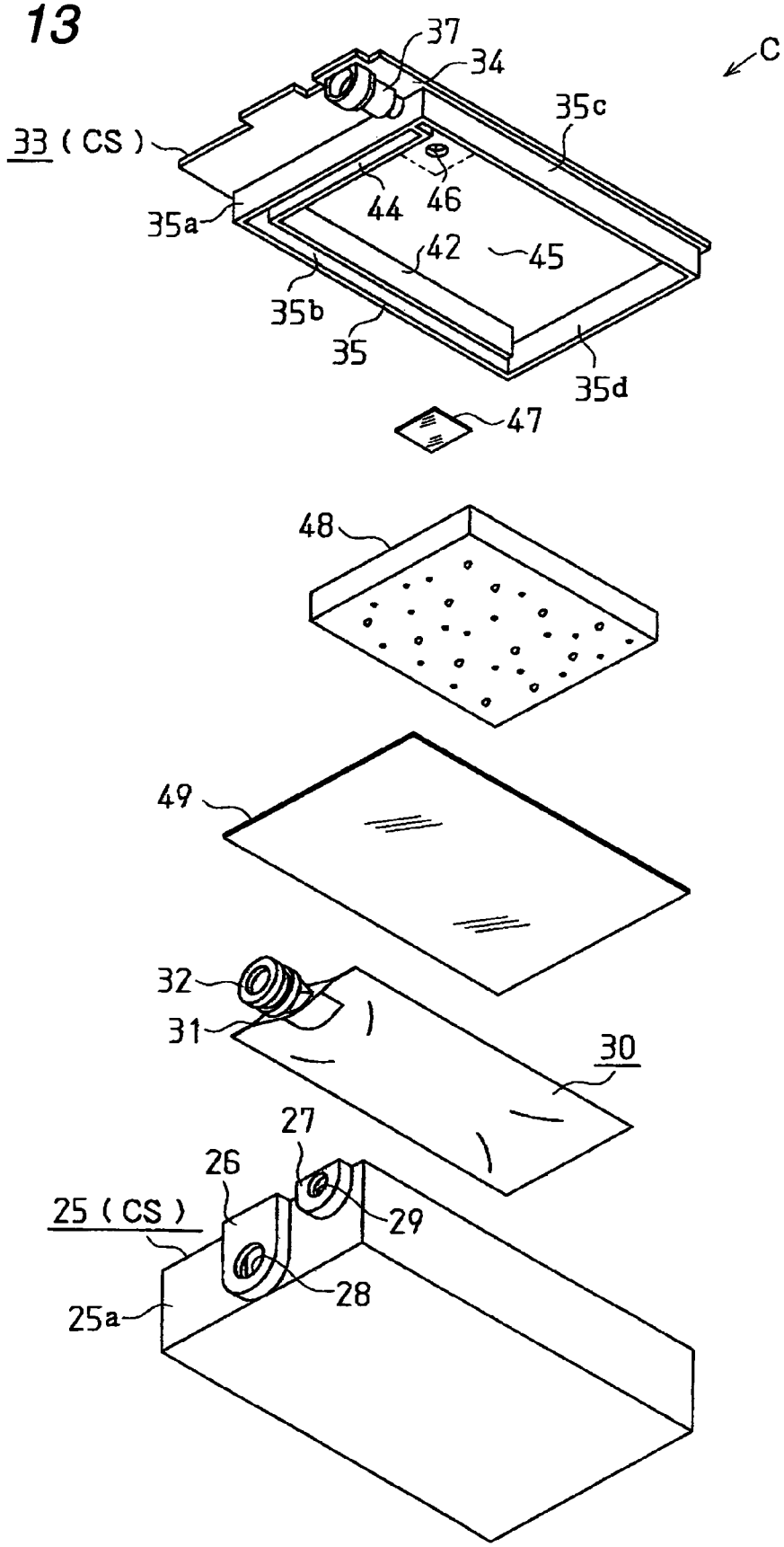
FIG. 13 is an exploded perspective view showing the cartridge in FIG. 8.
Figure 14:
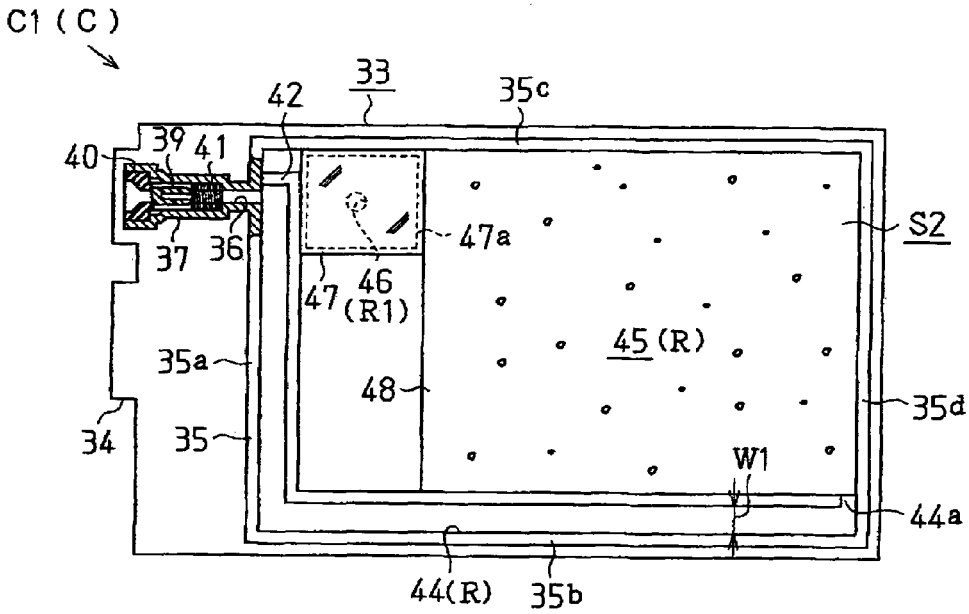
FIG. 14 is a bottom view showing an upper cover in the cartridge of FIG. 8.
Figure 15:
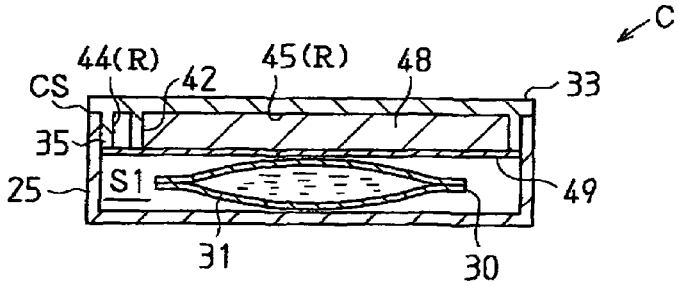
FIG. 15 is a sectional view showing the cartridge in FIG. 8.

Next, each cartridge C will be described which reference to FIGS. 12 to 15. FIG. 12 is a perspective view showing the cartridge C, FIG. 13 is an exploded perspective view showing the cartridge C, FIG. 14 is a bottom view showing the upper cover of the cartridge C, and FIG. 15 is a cross sectional view showing the cartridge C. The ink cartridge C shown in FIGS. 12 to 15 is almost identical to the ink cartridge C shown in FIGS. 2 to 6. Accordingly, description will be given to the ink cartridge C again with reference to FIGS. 12 to 15, and the description related to the ink cartridge C shown in FIGS. 2 to 6 can also be applied properly to the description of the ink cartridge C shown in FIGS. 12 to 15.

As shown in FIG. 12, the cartridge C includes a case CS taking the shape of an almost rectangular parallelepiped and the case CS has a lower cover 25. The lower cover 25 is formed to take the shape of a box with an upper side opened. A front wall portion 25*a* of the lower cover 25 is provided with a lead-out portion 26 and a lead-in portion 27 which have holes 28 and 29 on almost centers thereof in order to penetrate through the front wall portion 25*a*. Moreover, the lead-in portion 27 is provided above the lead-out portion 26 in the front wall portion 25*a*.

An ink pack 80 shown in FIG. 13 is accommodated in the lower cover 25. The ink pack 30 includes an ink bag 31 and an outlet 32. The ink bag 31 is formed by a film constituted by a flexible material. The outlet 32 has such a structure that one of ends is protruded from the ink bag 31 and the other end is inserted and fixed into the ink bag 31, and an ink in the ink bag 31 is led out. When the ink pack 30 is to be accommodated in the lower cover 25, the outlet 32 is engaged from the inside of the lead-out portion 26 in such a manner that an ink needle (not shown) can be inserted into the outlet 32 through the hole 28 of the lead-out portion 26.

An upper cover 33 constituting a case is fixed to the lower cover 25 accommodating the ink pack 30 therein. The upper cover 33 includes a rectangular plate-shaped portion 34 and an internal frame portion 35 erected like a frame at the lower surface of the plate-shaped portion 34 as shown in FIG. 13. The internal frame portion 35 has a front wall portion 35*a*, a left wall portion 35*b*, a right wall portion 35*c* and a back wall portion 35*d*.

As shown in FIG. 14, a through hole 36 for causing the inside and outside of the front wall portion 35*a* to communicate with each other is formed in the position of the front wall portion 35*a* which is close to the right wall portion 35*c*. The through hole 36 is formed in a waste ink introducing portion 37 to be a lead-in portion which is provided to be continuously linked to the front wall portion 35*a* of the internal frame portion 35. The waste ink introducing portion 37 is provided with a valve mechanism including a valve member 39, a valve seat 40, and an energizing spring 41 for energizing the valve member 39 toward the valve seat 40. A waste liquid needle N2 (see FIG. 11) provided on the tip of the connecting portion 5 is inserted into the inserting port of the waste ink introducing portion 37. When the waste liquid needle N2 is inserted, the valve member 39 is separated from the valve seat 40 against the energizing force of the energizing spring 41. Consequently, the inside and outside of the internal frame portion 35 are caused to communicate with each other via the through hole 36.

As shown in FIGS. 13 and 14, moreover, an almost L-shaped dividing portion 42 is erected on the inside of the internal frame portion 35 in the plate-shaped portion 34. The dividing portion 42 is provided in almost parallel with the front wall portion 35*a* and the left wall portion 35D, and a rear end thereof is formed to be expanded and opened with the back wall portion 35*d*. Moreover, the front end of the dividing portion 42 is formed to be continuously linked with the front wall portion 35*a* to surround the through hole 36. As a result, the inner part of the internal frame portion 35 is divided into a flow path 44 and a waste ink reservoir portion 45 to be a waste liquid reservoir portion through the dividing portion 42. The flow path 44 is formed like a groove between the dividing portion 42 and the front wall portion 35*a* and left wall portion 35*b*, and is bent at the front and left corner portion of the upper cover 33 with the through hole 36 side to be a starting end and is extended along the left wall portion 35*b*. Moreover, the waste ink reservoir portion 45 is a space provided between the dividing portion 42 and the right wall portion 85*c* and back wall portion 35*d*, and the flow path 44 and the waste ink reservoir portion 45 are caused to communicate with each other through an enlarging and opening portion 44*a* between the dividing portion 42 and the back wall portion 85*d*.

As shown in FIG. 13, moreover, an air communicating hole 46 to be an open hole is formed to penetrate through the plate-shaped portion 34 in a position corresponding to the front and right corner portion of the waste ink reservoir portion 45. The air communicating hole 46 is blocked by sticking a rectangular air permeable film 47 to the lower surface of the plate-shaped portion 34 as shown in FIG. 14. In the example, the film 47 may have only an air permeability but it is preferable that the film 47 should have both the air permeability and a liquid repellency. As shown in a broken line of FIG. 14, moreover, only an edge 47*a* of the air permeable film 47 is stuck to the plate-shaped portion 34 and a clearance is provided between the air permeable film 47 and the plate-shaped portion 34. As described above, moreover, the air permeable film 47 has at least the air permeability. For this reason, the air permeable film 47 causes air (a gas) in the waste ink reservoir portion 45 to pass therethrough, while it does not cause a liquid such as an ink to pass therethrough. As described in the first embodiment, furthermore, in the case in which the air permeable film 47 has the liquid repellency, it repels the ink so that the ink sticks thereto with difficulty.

An absorber 48 shown in FIG. 13 is provided in the waste ink reservoir portion 45 sticking the air permeable film 47 thereto. The absorber 48 is cut to have such a length as not to overlap with the air permeable film 47. A film 49 shown in FIG. 13 which is formed to have such a shape as to seal the opening of the internal frame portion 35 is stuck to the lower surface of the internal frame portion 35 of the upper cover 33 provided with the absorber 48. When the inside of the internal frame portion 35 is sealed with the film 49 as shown in FIG. 15, the waste ink reservoir portion 45 and the flow path 44 are closed. Consequently, a cartridge side flow path R constituted by the flow path 44, the waste ink reservoir portion 45 and the air communicating hole 46 is formed so that a second housing portion S2 is provided in the upper cover 33. Moreover, the air communicating hole 46 constitutes an exhaust flow path R1.

When the waste ink is introduced from the waste ink introducing portion 37, it is sent to the waste ink reservoir portion 45 through the flow path 44 and is absorbed in the absorber 48. Moreover, air contained in the waste ink passes through the air permeable film 47 and is pushed out of the air communicating hole 46.

When the upper cover 33 is fixed to the lower cover 25, the waste ink introducing portion 37 is maintained to be fitted in the inside surface of the lead-in portion 27 of the lower cover 25. As a result, the waste liquid needle N2 can be inserted into the waste ink introducing portion 37 through the hole 29 of the lead-in portion 27. Moreover, the first housing portion S1 is provided between the inside surface of the lower cover 25 and the film 49 of the upper cover 33, and the ink pack 30 is accommodated in the first housing portion S1.

On the other hand, the flow path 44 of the cartridge C is formed in such a manner that a flow path resistance thereof is varied depending on the cartridge C. More specifically, the first cartridge C1 for accommodating a black ink is formed in such a manner that a flow path sectional area A1 of the flow path 44 is the largest and flow path sectional areas A2 to A4 of the second to fourth cartridges C2 to C4 are smaller than the flow path sectional area A1 of the first cartridge C1 (A1>A2=A3=A4).

Figure 16:
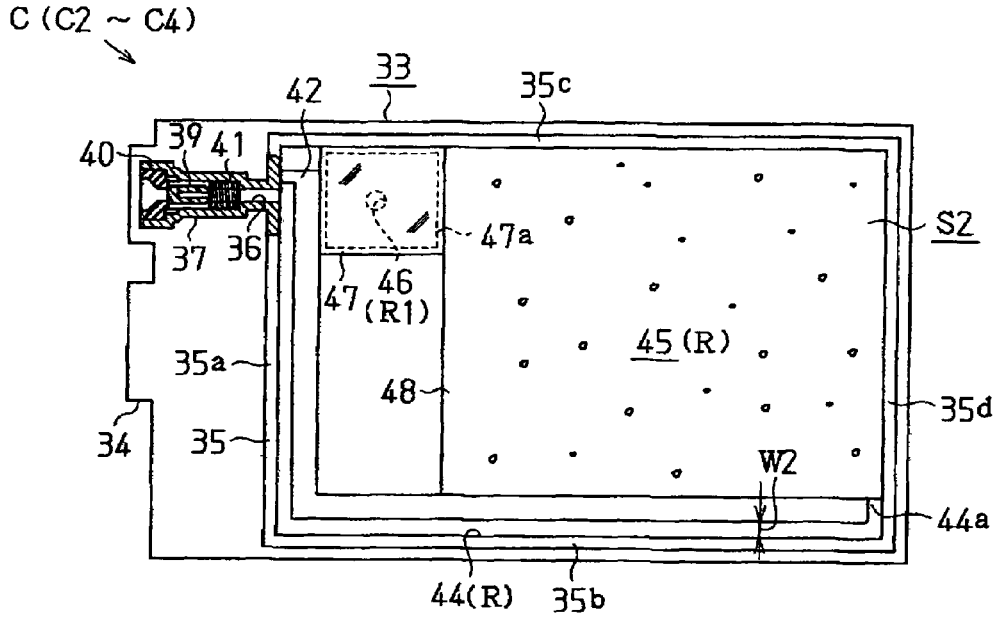
FIG. 16 is a bottom view showing an upper cover in another cartridge to be attached to the printer in FIG. 8.

In detail, the dividing portion 42 of the first cartridge C1 is provided in such a manner that a width between the front wall portion 35*a* and the left wall portion 35*b* is set to be a width W1 as shown in FIG. 14. More specifically, the width of the flow path 44 of the first cartridge C1 is equal to the width W1. As shown in FIG. 16, the flow path 44 of each of the second to fourth cartridges C2 to C4 is formed to have a width W2 which is smaller than the width W1. Moreover, the lengths of the flow paths of the first cartridge C1 and the second to fourth cartridges C2 to C4 are equal to each other and the capacities of the waste ink reservoir portions 45 are equal to each other.

For this reason, referring to the first cartridge C1 and the second to fourth cartridges C2 to C4, only the widths W1 and W2 of the flow paths 44 are different from each other (that is, W1>W2), and other structures are the same. Accordingly, the flow path resistance of the flow path 44 of the first cartridge C1 for accommodating the black ink (the cartridge side flow path R) is the lowest and the flow path resistances of the flow paths 44 of the second to fourth cartridges C2 to C4 (the cartridge side flow path R) are equal to each other.

Next, description will be given to a waste ink collecting procedure for the printer 1. The printer 1 carries out suction cleaning by means of the maintenance mechanism 15 in a predetermined timing. In the suction cleaning, the sucking pump 19 is driven with the cap 16 sealing the lower surface of the recording head 10 as described above. Consequently, the ink and the air are discharged from the nozzle N of the recording head 10 into the cap 16 so that the ink thus discharged is transmitted to the waste ink flow path 20 provided in the connecting portion 5 through the sucking pump 19.

The waste ink flowing from the inlet 20*a* of the waste ink flow path 20 is distributed to the waste ink reservoir portion 45 of each cartridge C based on the flow path resistance of the cartridge side flow path R of the cartridge C. At this time, although the flow path lengths from the inlet 20*a* of the waste ink flow path 20 to the waste ink reservoir portions 46 of the first and second cartridges C1 and C2 are equal to each other, the waste ink is introduced into the first cartridge C1 with priority to the second cartridge C2 In the third and fourth cartridges C3 and C4, the waste ink is stored in a smaller amount than that in each of the first and second cartridges C1 and C2 based on the flow path length from the inlet 20*a* to the inlet of the waste ink introducing portion 37 and the flow path resistance of the flow path 44.

When the cleaning is carried out plural times, the filling rate of the waste ink in the waste ink reservoir portion 45 of the first cartridge C1 is higher than that of the waste ink reservoir portion 45 of each of the second to fourth cartridges C2 to C4. As described above, moreover, the amount of consumption of an ink in the first cartridge C1 is large so that an exchange time comes early. Accordingly, the waste ink reservoir portion 45 having a high filling rate is exchanged comparatively early with the exchange of the first cartridge C1. In other words, the waste ink can be often discarded in a comparatively large amount. Even if the capacity of each cartridge C is comparatively small, therefore, the waste ink can be stored without a leakage. The waste ink filling rate (waste liquid filling rate) implies a rate of the volume of the waste ink reservoir portion 45 occupied by the waste ink.

Also in the case in which the first cartridge C1 having an early exchange time is unavoidably provided in a distant position from the inlet 20*a* of the waste ink flow path 20 on the layout of the printer 1 (the position of the fourth cartridge C4 in FIG. 11), moreover, the waste ink filling rate of the first cartridge C1 is increased by setting the flow path resistance of the flow path 44 in the first cartridge C1 to be lower than that of each of the other ink cartridges C.

According to the third embodiment, it is possible to obtain the following advantages.

(1) In the first embodiment, each cartridge C includes the first housing portion S1 for storing an unused ink and the second housing portion S2 for storing the waste ink Each cartridge C is provided with the cartridge side flow path R, and the cartridge side flow path R is constituted by the waste in reservoir portion 45, the flow path 44 communicating with the waste ink reservoir portion 45 from the waste ink introducing portion 37, and the air communicating hole 46. Furthermore, the flow path resistance of the cartridge side flow path R of the first cartridge C1 having an early exchange time is set to be lower than the flow path resistances of the second to fourth cartridges C2 to C4. For this reason, when the waste ink is fed out of the maintenance mechanism 15, the waste ink can easily be transmitted to the first cartridge C1. Therefore, it is possible to increase the waste ink filling rate of the first cartridge C1. More specifically, the waste ink can be often discarded in a comparatively large amount. Even if the capacity of the waste ink reservoir portion 45 of each cartridge C is small, therefore, the waste ink can be collected without a leakage. Accordingly, it is possible to reduce the sizes of the waste ink reservoir portion 45 and the cartridge C. Moreover, it is possible to control the filling rate of the waste ink of each cartridge C with a simple structure without providing a valve. Furthermore, the resistances of the flow paths provided in the cartridges C are caused to be different from each other. Therefore, it is possible to cause the waste ink filling rates of the cartridges C to be different from each other without changing the structures of the supply flow path 4, the discharge flow path 18 and the waste ink flow path 20 which are provided on the printer 1 side and the layout of the cartridges C.

(2) In the third embodiment, the internal frame portion 35 and the dividing portion 42 are erected on the upper cover 33 of the cartridge C. The flow path sectional area of the flow path 44 for the waste ink which is constituted by the internal frame portion 35 and the dividing portion 42 is varied by a change in the position of the dividing portion 42. In other words, the flow path sectional area A1 (the width W1) of the flow path 44 of the first cartridge C1 is increased and the flow path sectional areas A2 to A4 (the width W2) of the second to fourth cartridges C2 to C4 are set to be smaller than the flow path sectional area A1. Therefore, it is possible to cause the flow path resistances of the flow paths 44 to be different from each other by setting the structure of each cartridge C to be identical in places other than the position of the dividing portion 42.

Fourth Embodiment

Next, a fourth embodiment carrying out the invention will be described with reference to FIGS. 17 and 18. In a structure according to the fourth embodiment, the cartridge C according to the third embodiment is simply changed. Therefore, the detailed description of the same portions will be omitted.

Figure 17:
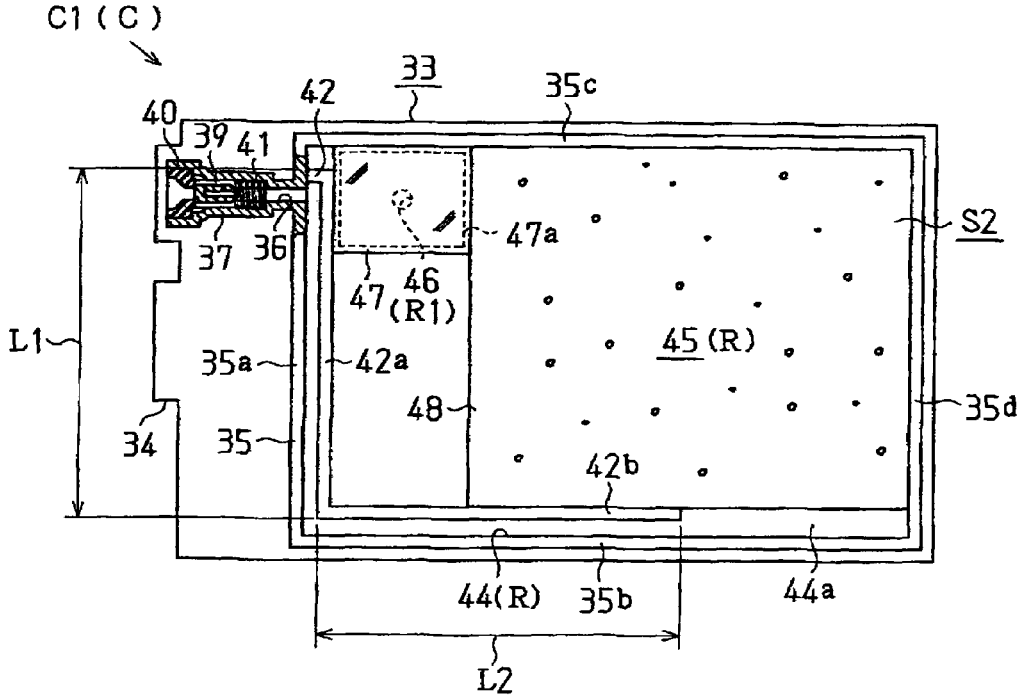
FIG. 17 is a bottom view showing an upper cover in a cartridge according to a fourth embodiment.

In the embodiment, as shown in FIG. 17, a dividing portion 42 of a first cartridge C1 is constituted, and a first dividing portion 42*a* provided in parallel with a front wall portion 35*a* is formed in such a manner that a length thereof is set to be L1. Moreover, a second dividing portion 42*b* which similarly constitutes the dividing portion 42 is provided in parallel with a left wall portion 35*b* and has a length set to be L2. By this structure, a flow path 44 for causing a waste ink introducing portion 37 to communicate with a waste ink reservoir portion 45 has a flow path length La which is almost equal to a length obtained by adding the length L1 of the first dividing portion 42*a* to the length L2 of the second dividing portion 42*b* (that is, La=L1+L2).

Figure 18:
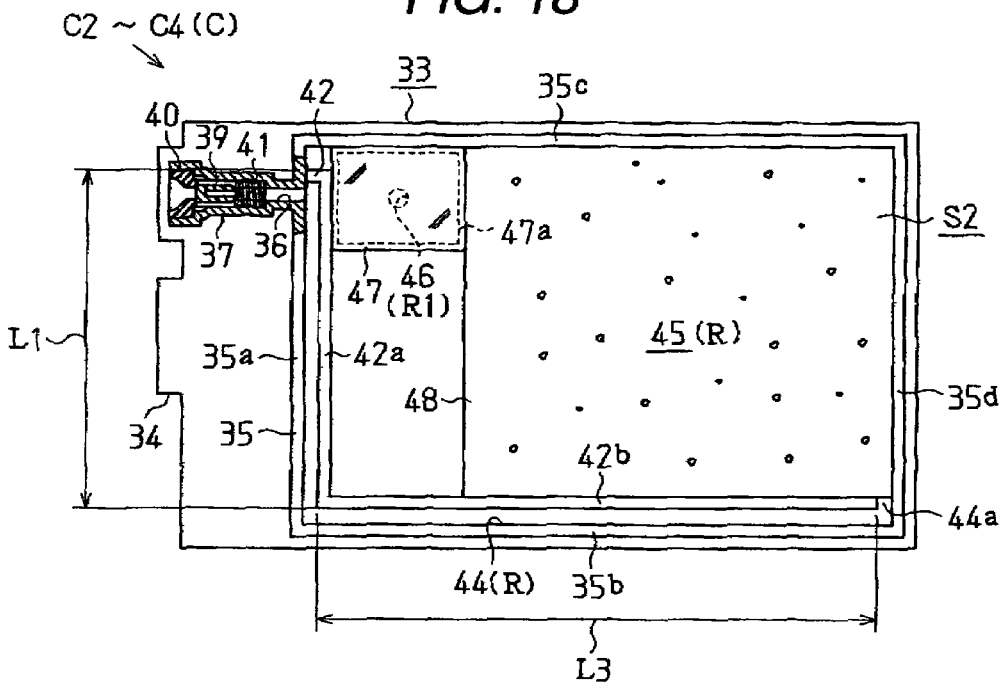
FIG. 18 is a bottom view showing an upper cover in another cartridge according to the fourth embodiment.

As shown in FIG. 18, moreover, the first dividing portion 42*a* constituting the dividing portion 42 of each of second to fourth cartridges C2 to C4 has a length which is equal to the length of the first dividing portion 42*a* of the first cartridge C1 (the length L1). Moreover, the second dividing portion 42*b* formed in parallel with the left wall portion 35*b* is provided to have a length L3 in such a manner that it is longer than the second dividing portion 42*b* of the first cartridge C1 (that is, L3>L2). For this reason, an expanding and opening portion 44*a* provided in each of the second to fourth cartridges C2 to C4 is smaller than the expanding and opening portion 44*a* of the first cartridge C1. Therefore, the flow path 44 for each of the second to fourth cartridges C2 to C4 has a flow path length Lb which is greater than the flow path length La of the first cartridge C1 (that is, Lb>La).

In the first to fourth cartridges C1 to C4, structures other than the dividing portions 42 are identical. For this reason, the flow path resistance of the flow path 44 of the first cartridge C1 is smaller than that of the flow path 44 of each of the second to fourth cartridges C2 to C4. Accordingly, the waste ink filling rate of the first cartridge C1 is higher than that in each of the other cartridges C.

According to the fourth embodiment, therefore, it is possible to obtain the following advantages in addition to the advantages described in (1) of the third embodiment.

(3) In the fourth embodiment, an internal frame portion 35 and the dividing portion 42 are erected on an upper cover 33 of the cartridge C. By a change in the length of the dividing portion 42 through the cartridge C, the flow path length of the flow path 44 constituted by the internal frame portion 35 and the dividing portion 42 is varied. In other words, the flow path length La of the first cartridge C1 is reduced and the flow path length Lb of each of the second to fourth cartridges C2 to C4 is set to be greater than the flow path length La. Therefore, it is possible to set the structure of each cartridge C to be identical in a place other than the position of the dividing portion 42, thereby causing the flow path resistances of the flow paths 44 to be different from each other.

Fifth Embodiment

Next, a fifth embodiment carrying out the invention will be described with reference to FIG. 19. In a structure according to the fifth embodiment, the cartridge C according to the third embodiment is simply changed. Therefore, the detailed description of the same portions will be omitted.

Figure 19:
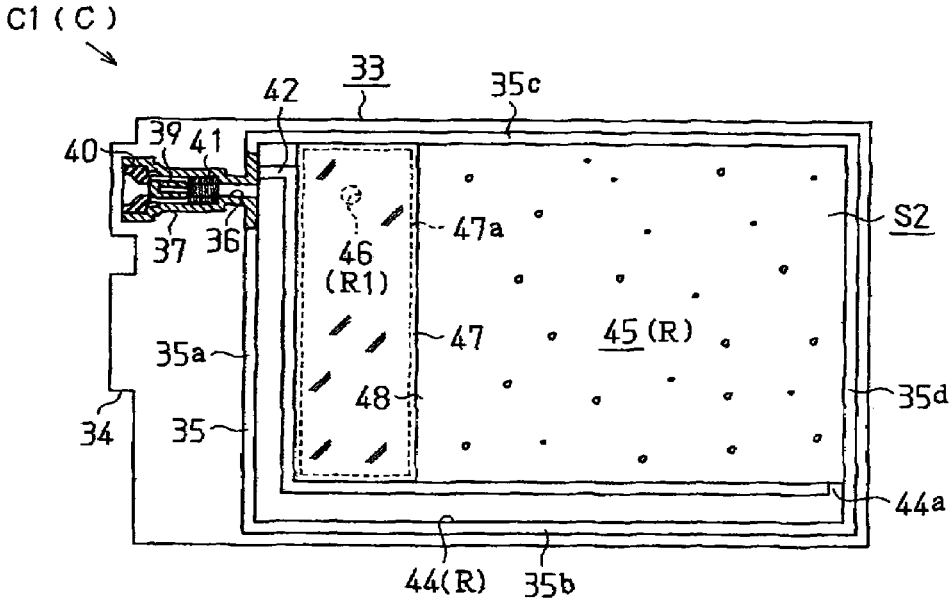
FIG. 19 is a bottom view showing an upper cover in a cartridge according to a fifth embodiment.

As shown in FIG. 19, in a first cartridge C1, an air permeable film 47 for blocking an air communicating hole 46 has a length from the inside surface of a right wall portion 35*c* to a dividing portion 42. Moreover, the air permeable film 47 has only an edge 47*a* stuck to a plate-shaped portion 84 as described above. Accordingly, air in a waste ink reservoir portion 45 passes through a portion other than the edge 47*a* of the air permeable film 47 and flows into a portion between the air permeable film 47 and the plate-shaped portion 34, and is discharged from the air communicating hole 46. The air passes through the portion of the air permeable film 47 other than the edge 47*a* and an air permeable area M1 is obtained.

The air permeable film 47 in each of second to fourth cartridges C2 to C4 has such a length as not to reach the dividing portion 42 on the left wall portion 35*b* side from the inside surface of the right wall portion 35*c* of the upper cover 33 and the air permeable area is set to be an air permeable area M2 which is smaller than the air permeable area M1 of the air permeable film 47 of the first cartridge C1 (that is, M2<M1) as shown in FIG. 18. More specifically, a space provided between the air permeable film 47 of the first cartridge C1 and the plate-shaped portion 34 is large and air can be caused to pass in a comparatively large amount. Therefore, the air permeability of the air permeable film 47 of the first cartridge C1 is higher than that of the air permeable film 47 of each of the other cartridges C. The air permeability indicates the air permeable amount of a gas per unit time in which the air permeable film 47 transmits the air on the same conditions such as a constant pressure and a constant temperature.

Accordingly, the first cartridge C1 easily discharges the air in the waste ink reservoir portion 45. Therefore, the flow path resistance of a cartridge side flow path R is lower than that in each of the other cartridges C. For this reason, the first cartridge C1 has a higher waste ink filling rate than that of each of the other cartridges C.

According to the fifth embodiment, therefore, it is possible to obtain the following advantages in addition to the advantages described in (1) of the third embodiment.

(4) In the fifth embodiment, the size of the air permeable film 47 for blocking the air communicating hole 46 is varied depending on each of the cartridges C. In other words, the air permeable area M1 of the air permeable film 47 provided in the first cartridge C1 is set to be large and the air-permeable area M2 of the air permeable film 47 provided in each of the second to fourth cartridges C2 to C4 is set to be smaller than the air permeable area M1. Therefore, it is possible to easily vary the flow path resistance of the cartridge side flow path R by only setting the structures of the cartridges C to be almost identical to each other and changing the size of the air permeable film 47.

Sixth Embodiment

Next, a sixth embodiment carrying out the invention will be described with reference to FIG. 20. In a structure according to the sixth embodiment, the cartridge C according to the third embodiment is simply changed. Therefore, the detailed description of the same portions will be omitted.

Figure 20:
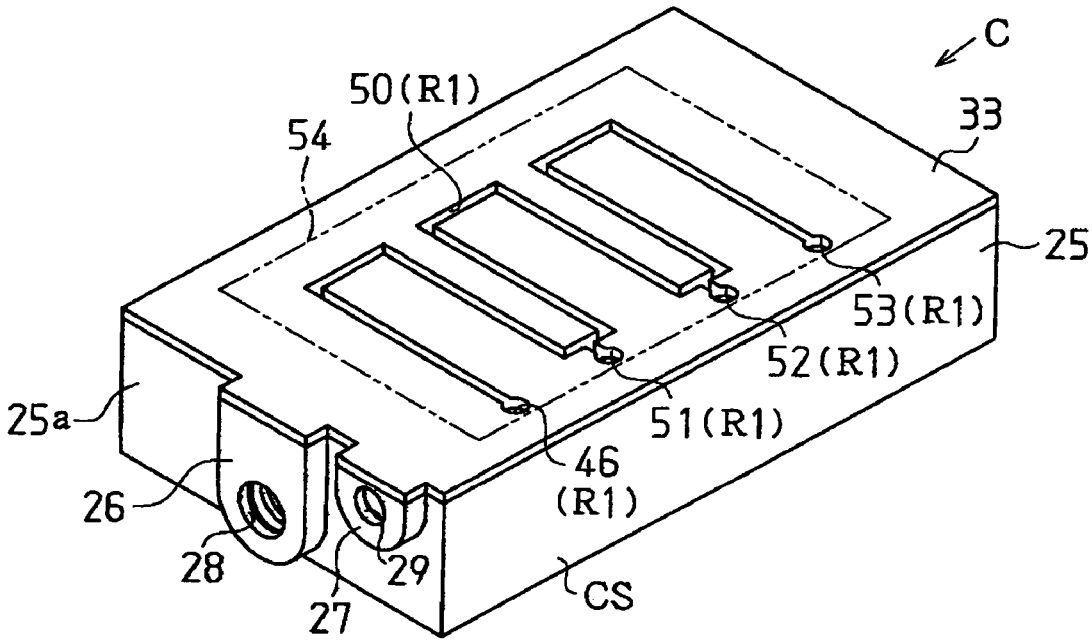
FIG. 20 is a perspective view showing a cartridge according to a sixth embodiment.

As shown in FIG. 20, a cartridge C according to the embodiment comprises a communicating groove 50 on the upper surface of an upper cover 33 constituting a case in addition to the structure according to the first embodiment. The communicating groove 50 is formed in such a manner that an upper surface side is opened, and is extended to meander over the upper surface of the upper cover 33 from an air communicating hole 46. In the upper cover 33, moreover, first to third concave portions 51 to 53 to be open holes and air communicating portions are provided in the middle or end of the communicating groove 50. The first concave portion 51 is provided in the middle of the communicating groove 50 and is formed in a position in which a flow path length r1 from the air communicating hole 46 is the smallest. The second concave portion 52 is provided in the middle of the communicating groove 50 and is formed in such a manner that a flow path length r2 from the air communicating hole 46 is greater than the flow path length r1 of the first concave portion 51. The third concave portion 53 is provided on the termination of the communicating groove 50 and is formed in a position in which a flow path length r3 from the air communicating hole 46 is the greatest (that is, $r1<r2<r3$).

A sealing film 54 is stuck to the upper surface of the upper cover 33 so that the air communicating hole 46, the communicating groove 50 and the first to third concave portions 51 to 53 are sealed therewith. Accordingly, the air discharged from the air communicating hole 46 is not discharged to an outside until a hole is formed on the sealing film 54 to form an open hole communicating with the air communicating hole 46. Moreover, the air communicating hole 46, the communicating groove 60 and the first to third concave portions 51 to 53 constitute an exhaust flow path R1.

When the cartridge C is to be mounted on a printer 1, an open hole is formed on the sealing film 54 to be used. For example, in case of the cartridge C having an early exchange time, an open hole is formed on a portion of the sealing film 54 which is placed just above the air communicating hole 46. In case of the cartridge having a late exchange time, the open hole is formed just above the third concave portion 53. In other words, the open hole is formed in a position corresponding to any of the air communicating hole 46 and the first to third concave portions 51 to 53 in the sealing film 54 to vary the flow path resistance of the exhaust flow path R1 (a cartridge side flow path R) of each cartridge C depending on the exchange time of the cartridge C.

In the case in which a waste ink is introduced into the cartridge C, air contained in the waste ink passes through the air communicating hole 46 via an air permeable film 47 (see FIG. 14). For example, in the case in which the open hole is provided in the position of the third concave portion 53, the air discharged from the air communicating hole 46 passes through the communicating groove 50 and is discharged from the open hole to the outside.

According to the six embodiment; therefore, it is possible to obtain the following advantages in addition to the advantages described in (1) of the third embodiment.

(5) In the sixth embodiment, the communicating groove 50 communicating with the air communicating hole 46 is formed on the upper cover 33 and the first to third concave portions 51 to 53 are formed in the middle of the communicating groove 50. Moreover, the air communicating hole 46, the communicating groove 50 and the first to third concave portions 51 to 53 are sealed by sticking the sealing film 54. In use of the cartridge C, the open hole is formed in the position of the air communicating hole 46 or any of the first to third concave portions 51 to 53 corresponding to the exchange time of the cartridge C. Accordingly, it is possible to vary the length of the exhaust flow path R1 reaching the open hole from the air communicating hole 46 by changing the position of the open hole. When the first to third concave portions 51 to 53 are previously provided, moreover, a suitable position for forming the open hole is known. Therefore, the flow path resistance can easily be varied. Also in the case in which an ink having a large amount of consumption is varied depending on the type or use situation of the printer 1, furthermore, it is possible to properly change the cartridge C having a high waste ink filling rate.

(6) In the sixth embodiment, the cartridges C for accommodating various inks are set to have the same structures and the open hole is formed in use. Consequently, the flow path resistance of the cartridge side flow path R of each cartridge C is varied. Accordingly, it is not necessary to set the structures of the cartridges C to be different from each other. Thus, it is possible to decrease the number of components.

Seventh Embodiment

Next, a seventh embodiment carrying out the invention win be described with reference to FIG. 14. In a structure according to the seventh embodiment, the cartridge C according to the third embodiment is simply changed. Therefore, the detailed description of the same portions will be omitted.

A cartridge C according to the embodiment is formed in such a manner that the thickness or material of an air permeable film 47 is varied depending on the cartridge C.

For example, the air permeable film 47 of each of second to fourth cartridges C2 to C4 is formed more thickly as compared with the air permeable film 47 of a first cartridge C1. For this reason, the air permeability of the air permeable film 47 of each of the second to fourth cartridges C2 to C4 is smaller than that of the air permeable film 47 of the first cartridge C1.

Alternatively, the material of the air permeable film 47 of the first cartridge C1 is different from that of the air permeable film 47 of each of the second to fourth cartridges C2 to C4. For example, in the case in which the air permeable film 47 is formed by a porous material, the number of fine holes of the air permeable film 47 of the first cartridge C1 is increased or the fine holes are enlarged, resulting in an increase in the air permeability of the air permeable film 47 itself. Thus, the air permeabilities of the air permeable films 47 provided in the middle of a cartridge side flow path R are different from each other. Consequently, the flow path resistance of the cartridge side flow path R of the first cartridge C1 is lower than that of each of the second to fourth cartridges C2 to C4.

According to the seventh embodiment, therefore, it is possible to obtain the following advantages in addition to the advantages described in (1) of the third embodiment.

(7) in the seventh embodiment, the thickness or material of the air permeable film 47 for blocking an air communicating hole 46 is varied depending on the cartridge C. In other words, the thickness or material of the air permeable film 47 provided in the first cartridge C1 is changed in such a manner that the air permeability of the air permeable film 47 is increased. Therefore, it is possible to easily vary the flow path resistance of the cartridge side flow path R by only setting the structures of the cartridges C to be almost identical to each other and changing the thickness or material of the air permeable film 47.

The embodiments may be changed in the following manner.

- While the waste ink collecting system has the ink cartridges C connected in parallel in the second to seventh embodiments, they may be connected in series. At this time, the waste liquid lead-out portion for leading out the waste ink to the upper cover 33 is provided, and the waste liquid lead-out portions and the waste liquid lead-in portions 37 in the adjacent ink cartridges C are connected to each other through the waste ink tube 18. When the waste ink is discharged to the ink cartridge C collecting the waste ink in a maximum amount, it is discharged to the adjacent ink cartridges C through the waste liquid lead-out portion, the waste ink tube 18 and the waste liquid lead-in portion 37.
- While the flow path sectional areas are equal to each other and only the flow pass lengths from the pump 19 are different from each other in the waste ink tubes 18 connected to the ink cartridges C1 and C2 in the second embodiment, the flow path sectional areas may be different from each other or the flow path lengths may be equal to each other. Similarly, the flow path sectional areas or the flow path lengths in the waste ink tubes 18 may be different from each other in the third to seventh embodiments.
- While the air communicating hole 46 is provided on the upper cover 83 in each of the embodiments, it may be provided on the film 49. In this case, the film 47 may be stuck to the upper cover 33 side or the lower cover 35 side of the film 49.
- While the waste ink absorber 48 is formed to take such a size as not to come in contact with the film 47 in each of the embodiments, the size may be set to be exactly fitted in the internal frame portion 35 and the waste ink absorber 48 may come in contact with the film 47
- While the waste ink absorber 48 is not attached to the flow path 44 in each of the embodiments, it may be fitted in the flow path 44.

Each of the embodiments may be changed in the following manner.

- While one, four or six cartridge(s) C is/are mounted on the printer 1 in each of the embodiments, the number of the ink cartridges 1 may be two or more other than them.
- In each of the second to seventh embodiments, the waste ink reservoir portions 45 of the cartridges C may be formed in such a manner that their capacities are different from each other. For example, in the case in which the amount of consumption of a black ink is the largest and the capacity of the waste ink reservoir portion 45 of the cartridge C for the black ink is larger than that of each of the other waste ink reservoir portions 45, the flow path resistance of the cartridge side flow path R may be changed in such a manner that a waste ink filling rate has a predetermined value or more at the exchange time of the cartridge C for the black ink.
- In each of the third to seventh embodiments, the flow path resistance of the first cartridge C1 for accommodating the black ink is set to be the lowest and the flow path resistance of each of the second to fourth cartridges C2 to C4 is set to be high. In addition, the flow path resistance of the cartridge C other than the first cartridge C1 may be set to be the lowest. Moreover, the flow path resistances of the cartridges C may be set to be the lowest. Furthermore, the cartridges C may be formed in such a manner that all of the flow path resistances are different from each other. In brief, it is preferable to reduce the flow path resistance of any of the cartridges C which has a large amount of consumption of an ink (an early exchange time).
- While the waste ink flow path 20 is provided in the connecting portion 5 in the third to seventh embodiments, this structure is not restricted but a tube may be provided.
- The position of each of the cartridges C in the second to seventh embodiments is not restricted to the arrangement order shown in FIGS. 7 and 11.
- In each of the embodiments, the flow path 44 does not need to be provided like an L shape. For example, the flow path 44 may be formed like a straight line in which an almost U shape and a bent portion are not provided.
- In the third to seventh embodiments, the flow path resistance of the flow path 44 may be varied by a change in the shape of the internal frame portion 35 or that of the dividing portion 42. For example, the flow path 44 of the first cartridge C1 may be formed like a straight line and the flow paths 44 of the other cartridges C may be formed to be bent. Alternatively, the flow path sectional area of the flow path 44 may be continuously decreased gradually toward a downstream or a member for disturbing the flow of a fluid may be provided in the middle of the flow path 44 to increase the flow path resistance.
- In the sixth embodiment, the flow path resistance of the cartridge side flow path R may be varied by a change in the flow path sectional area of the exhaust flow path R1 from the air communicating hole 46 to the open hole. Moreover, a plurality of communicating grooves 50 may be provided. In this case, the communicating grooves 50 are formed to communicate with the air communicating hole 46 of the upper cover 83. The communicating grooves 50 are formed in such a manner that lengths and sectional areas are different from each other. In use of the cartridge C, the open hole corresponding to any of the communicating grooves 50 is formed to open the communicating groove 60 to the air. Thus, it is possible to cause the flow path resistances of the cartridge side flow paths R of the cartridges C to be different from each other depending on the flow path resistance of the communicating groove 50 which is opened to the air.

While the printer 1 for discharging an ink has been described as the liquid injecting apparatus in each of the embodiments, other liquid injecting apparatuses may be employed. For example, it is also possible to employ a printing apparatus including a fax and a copier, a liquid injecting apparatus for injecting a liquid such as an electrode material or a coloring agent to be used for manufacturing a liquid crystal display, an EL display and a surface emitting display, a liquid injecting apparatus for injecting a bioorganism to be used for manufacturing a biochip, and a sample injecting apparatus to be a precision pipette. Moreover, a liquid is not restricted to an ink but an application to other liquids may be carried out.

What is claimed is:

1. A waste liquid collecting method for a liquid ejecting apparatus having a liquid ejecting head for discharging a liquid and a maintenance mechanism for sucking at least some of the liquid from the liquid ejecting head; the method comprising the steps of:

providing a plurality of cartridges, each for storing a liquid to be supplied to the liquid ejecting head, one of the cartridges containing ink which is consumed at a higher rate than ink in the other cartridges wherein each of the plurality of cartridges includes a waste liquid reservoir portion for storing a waste liquid discharged from the maintenance mechanism, an introducing portion for introducing the waste liquid into the waste liquid reservoir portion, and an open hole for discharging at least some of a gas in the waste liquid reservoir portion to an outside, wherein a flow path resistance of a cartridge side flow path from the introducing portion to the open hole through the waste liquid reservoir portion for the cartridge containing ink which is consumed at the higher rate is less than a flow path resistance of the other cartridges; and introducing an amount of the waste liquid into the waste liquid reservoir portion of the cartridge having the ink that is consumed at the higher rate, the amount being greater than an amount of the waste liquid introduced into the other cartridges.

2. A set of ink cartridges concurrently mountable to a printer for printing an image using the ink cartridges, each of the ink cartridges comprising:

an ink reservoir portion;

a waste ink reservoir portion;

a waste ink inlet portion;

an air outlet portion; and a cartridge side flow path by which the waste ink inlet portion communicates through the waste ink reservoir portion with the air outlet portion, wherein a flow path resistance of the flow path in at least one of the ink cartridges is lower than a flow path resistance of the flow path in at least another one of the ink cartridges, wherein at least one of flow path sectional areas and flow path lengths in at least a property of the cartridge side flow paths provided in the cartridges differ from each other so that the flow path resistances of the cartridge side flow paths differ from each other.

3. The liquid ejecting apparatus according to claim 2, wherein each of flow path sectional areas or flow path lengths from the introducing portions to the waste liquid reservoir portions in the cartridge side flow paths are different from each other.

4. A set of ink cartridges concurrently mountable to a printer for printing an image using the ink cartridges, each of the ink cartridges comprising:

an ink reservoir portion;

a waste ink reservoir portion;

a waste ink inlet portion;

an air outlet portion; and a flow path by which the waste ink inlet portion communicates through the waste ink reservoir portion with the air outlet portion, wherein a flow path resistance of the flow path in at least one of the ink cartridges is lower than a flow path resistance of the flow path in at least another one of the ink cartridges, wherein, in the ink cartridges having different flow path resistances, air permeabilities of air permeable films provided in those cartridges to block the open hole differ from each other so that the flow path resistances of the cartridge side flow paths of those cartridges differ from each other.

5. The liquid ejecting apparatus according to claim 4, wherein air permeable areas of the air permeable films differ from each other.

6. The liquid ejecting apparatus according to claim 4, wherein thicknesses of the air permeable films differ from each other.

7. The liquid ejecting apparatus according to claim 4, wherein the air permeable films include different materials so that the air permeabilities of the air permeable films differ from each other.

8. A set of ink cartridges concurrently mountable to a printer for printing an image using the ink cartridges, each of the ink cartridges comprising:

an ink reservoir portion;

a waste ink reservoir portion;

a waste ink inlet portion;

an air outlet portion; and a flow path by which the waste ink inlet portion communicates through the waste ink reservoir portion with the air outlet portion, wherein a flow path resistance of the flow path in at least one of the ink cartridges is lower than a flow path resistance of the flow path in at least another one of the ink cartridges, wherein an exhaust flow path communicating with the waste liquid reservoir portion is provided in a case of each of the cartridges, and a plurality of air communicating portions which can be opened to air in use is formed in a middle of the exhaust flow path, and the air communicating portions are provided in such a manner that at least one of flow path lengths and flow path sectional areas from the waste liquid reservoir portions to the air communicating portions differ from each other.

9. A cartridge set comprising:

a plurality of cartridges each including a liquid reservoir portion for accommodating a liquid and a waste liquid reservoir portion for accommodating a waste liquid, wherein each cartridge has a flow path resistance of a cartridge side flow path reaching an open hole for discharging a gas in the waste liquid reservoir portions to an outside from an introducing portion formed on the cartridge through the waste liquid reservoir portion and the flow resistances differ from each other in correspondence with an amount of consumption of the liquid in each of the cartridges, and wherein a flow path resistance of a cartridge side flow path from the introducing portion to the open hole through the waste liquid reservoir portion for the cartridge containing ink which is consumed at the higher rate is less than a flow path resistance of the other cartridges.

10. A set of ink cartridges concurrently mountable to a printer for printing an image using the ink cartridges, each of the ink cartridges comprising:

an ink reservoir portion;

a waste ink reservoir portion;

a waste ink inlet portion;

an air outlet portion; and a flow path by which the waste ink inlet portion communicates through the waste ink reservoir portion with the air outlet portion, wherein a flow path resistance of the flow path in at least one of the ink cartridges is lower than a flow path resistance of the flow path in at least another one of the ink cartridges.

* * * * *